US008471799B2

(12) United States Patent
Li et al.

(10) Patent No.: US 8,471,799 B2
(45) Date of Patent: Jun. 25, 2013

(54) LIQUID CRYSTAL DISPLAY HAVING PIXEL DATA SELF-RETAINING FUNCTIONALITY AND OPERATION METHOD THEREOF

(75) Inventors: Yu-Hsuan Li, Hsin-Chu (TW); Yu-Jung Liu, Hsin-Chu (TW); Chun-Hung Kuo, Hsin-Chu (TW); Chun-Huai Li, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 463 days.

(21) Appl. No.: 12/754,607

(22) Filed: Apr. 6, 2010

(65) Prior Publication Data

US 2011/0090196 A1 Apr. 21, 2011

(30) Foreign Application Priority Data

Oct. 20, 2009 (TW) ..... 98135396 A

(51) Int. Cl.
*G09G 3/36* (2006.01)

(52) U.S. Cl.
USPC ..... 345/90

(58) Field of Classification Search
USPC ..... 345/209, 96, 87, 92, 90
See application file for complete search history.

(56) References Cited

U.S. PATENT DOCUMENTS

| | | | | |
|---|---|---|---|---|
| 6,771,247 | B2 | 8/2004 | Sato | |
| 6,778,162 | B2 | 8/2004 | Kimura | |
| 6,876,348 | B2 | 4/2005 | Murata | |
| 6,937,222 | B2 | 8/2005 | Numao | |
| 2003/0197673 | A1 * | 10/2003 | Nakamura | 345/99 |
| 2007/0040824 | A1 * | 2/2007 | Chen et al. | 345/211 |
| 2009/0109158 | A1 * | 4/2009 | Shirai | 345/94 |

FOREIGN PATENT DOCUMENTS

| | | | |
|---|---|---|---|
| CN | 1776801 | A | 5/2006 |
| CN | 1904706 | A | 1/2007 |

* cited by examiner

*Primary Examiner* — Chanh Nguyen
*Assistant Examiner* — Long D Pham
(74) *Attorney, Agent, or Firm* — Winston Hsu; Scott Margo

(57) ABSTRACT

A liquid crystal display having pixel data self-retaining functionality includes a gate line for delivering a gate signal, a data line for delivering a data signal, a control unit for providing a first control signal and a second control signal, a data switch, a voltage-control inverter, a liquid crystal capacitor, and a pass transistor. The data switch is utilized for inputting the data signal to become a first data signal according to the gate signal. The voltage-control inverter is utilized for inverting the first data signal to generate a second data signal furnished to the liquid crystal capacitor according to the enable operation of the first control signal. The pass transistor is used for passing the second data signal to become the first data signal or for passing the first data signal to become the second data signal according to the second control signal.

26 Claims, 15 Drawing Sheets

LIQUID CRYSTAL DISPLAY HAVING PIXEL DATA SELF-RETAINING FUNCTIONALITY AND OPERATION METHOD THEREOF

BACKGROUND OF THE INVENTION

1. Field of the Invention

The present invention relates to a liquid crystal display and an operation method thereof, and more particularly, to a liquid crystal display having pixel data self-retaining functionality and an operation method thereof.

2. Description of the Prior Art

Along with the advantages of thin appearance, low power consumption, and low radiation, liquid crystal displays (LCDs) have been widely applied in various electronic products for panel displaying. The operation of a liquid crystal display is featured by varying voltage drops between opposite sides of a liquid crystal layer for twisting the angles of the liquid crystal molecules in the liquid crystal layer so that the transmittance of the liquid crystal layer can be controlled for illustrating images with the aid of light source provided by a backlight module or ambient light. FIG. 1 is a schematic diagram showing a prior-art liquid crystal display 100. As shown in FIG. 1, the liquid crystal display 100 comprises a gate driver 110, a source driver 120, a gate line 130, a data line 140 and a pixel unit 150. The pixel unit 150 includes a data switch 155, a liquid crystal capacitor 180 and a storage capacitor 185. The source driver 120 is utilized for providing a data signal to be written into the pixel unit 150. The gate driver 110 is employed to generate a gate signal for providing a control of writing the data signal into the pixel unit 150.

In the operation of the liquid crystal display 100, even though the image being displayed is still, the gate driver 110 and the source driver 120 continue outputting the gate signal and the data signal so as to continue performing a periodical operation of writing the data signal into the pixel unit 150. That is, the power consumption of displaying a still frame is substantially identical to that of displaying motion frames. With the aim of reducing the power consumption of displaying a still frame, existing technology normally embeds a memory unit in each pixel unit. The memory unit embedded is devised based on the complicated architecture of static random access memory (SRAM). In view of that, the aperture ratio of each pixel unit is significantly reduced.

SUMMARY OF THE INVENTION

In accordance with an embodiment of the present invention, a liquid crystal display having pixel data self-retaining functionality is provided. The liquid crystal display comprises a gate line for delivering a gate signal, a data line for delivering a data signal, a data switch, a voltage-control inverter, a liquid crystal capacitor, a pass transistor, a control unit, a common voltage generation unit, and a power source. The data switch comprises a first end electrically connected to the data line for receiving the data signal, a gate end electrically connected to the gate line for receiving the gate signal, and a second end. The voltage-control inverter comprises an input end electrically connected to the second end of the data switch, an output end, and an enable end. The liquid crystal capacitor is electrically connected to the output end of the voltage-control inverter. The pass transistor comprises a first end electrically connected to the output end of the voltage-control inverter, a second end electrically connected to the input end of the voltage-control inverter, and a gate end. The control unit, electrically connected to the enable end of the voltage-control inverter and the gate end of the pass transistor, is utilized for controlling circuit operations of the voltage-control inverter and the pass transistor. The common voltage generation unit is electrically connected to the liquid crystal capacitor. The power source, electrically connected to the control unit and the common voltage generation unit, is put in use for powering the control unit and the common voltage generation unit.

The present invention further provides an operation method for use in a liquid crystal display. The liquid crystal display comprises a gate driver for providing a gate signal, a source driver for providing a data signal, a control unit for providing a first control signal and a second control signal, a data switch, a voltage-control inverter, a liquid crystal capacitor, a pass transistor, and a common voltage generation unit for providing a common voltage. The data switch is employed to provide a control of inputting the data signal to become a first data signal according to the gate signal. The voltage-control inverter is utilized for inverting the first data signal to generate a second data signal according to an enable operation of the first control signal. The liquid crystal capacitor is used for controlling liquid-crystal transmittance according to the second data signal and the common voltage. The pass transistor is put in use for providing a control of passing the second data signal to become the first data signal according to the second control signal, or for providing a control of passing the first data signal to become the second data signal according to the second control signal. The operation method comprises: the control unit providing the second control signal for turning off the pass transistor during a first still interval after the liquid crystal display enters a still mode; the control unit providing the first control signal so as to enable the voltage-control inverter for inverting the first data signal to generate the second data signal which is furnished to the liquid crystal capacitor during the first still interval; the control unit providing the first control signal for disabling the voltage-control inverter during a second still interval; the control unit providing the second control signal for turning off the pass transistor during the second still interval; the control unit providing the first control signal for disabling the voltage-control inverter during a third still interval; the control unit providing the second control signal for turning on the pass transistor so as to pass the second data signal to become the first data signal during the third still interval; the control unit providing the first control signal for disabling the voltage-control inverter during a fourth still interval; and the control unit providing the second control signal for turning off the pass transistor during the fourth still interval.

Moreover, the present invention provides another operation method for use in a liquid crystal display. The liquid crystal display comprises a gate driver for providing a gate signal, a source driver for providing a data signal, a control unit for providing a control signal, a data switch, a voltage-control inverter, a liquid crystal capacitor, a pass transistor, and a common voltage generation unit for providing a common voltage. The data switch is employed to provide a control of inputting the data signal to become a first data signal according to the gate signal. The voltage-control inverter is utilized for inverting the first data signal to generate a second data signal according to an enable operation of the control signal. The liquid crystal capacitor is used for controlling liquid-crystal transmittance according to the second data signal and the common voltage. The pass transistor is put in use for providing a control of passing the second data signal to become the first data signal according to the control signal, or for providing a control of passing the first data signal to become the second data signal according to the control signal. The operation method comprises: the control unit providing the control signal having a first voltage level for turning off the pass transistor and for enabling the voltage-control inverter so as to invert the first data signal for generating the second data signal furnished to the liquid crystal capacitor during a first still interval after the liquid crystal display enters a still mode; and the control unit providing the control signal having a second voltage level for disabling the voltage-control inverter and for turning on the pass transistor so as to pass the second data signal to become the first data signal during a second still interval.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the operation method are not meant thereto limit the operating sequence, and any rearrangement of the operating sequence for achieving same functionality is still within the spirit and scope of the invention.

Figure 1:
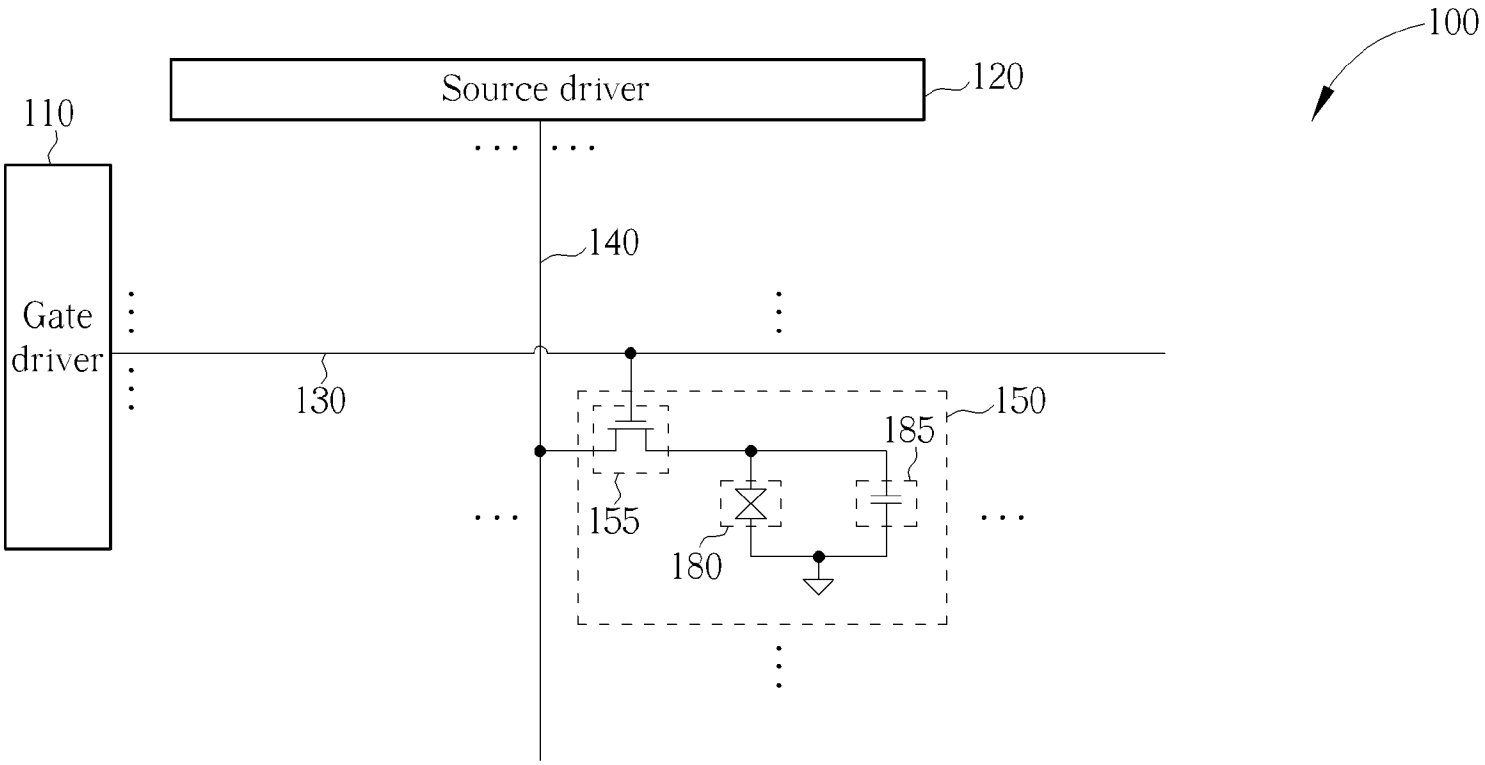
FIG. 1 PRIOR ART
FIG. 1 is a schematic diagram showing a prior-art liquid crystal display.
Figure 2:
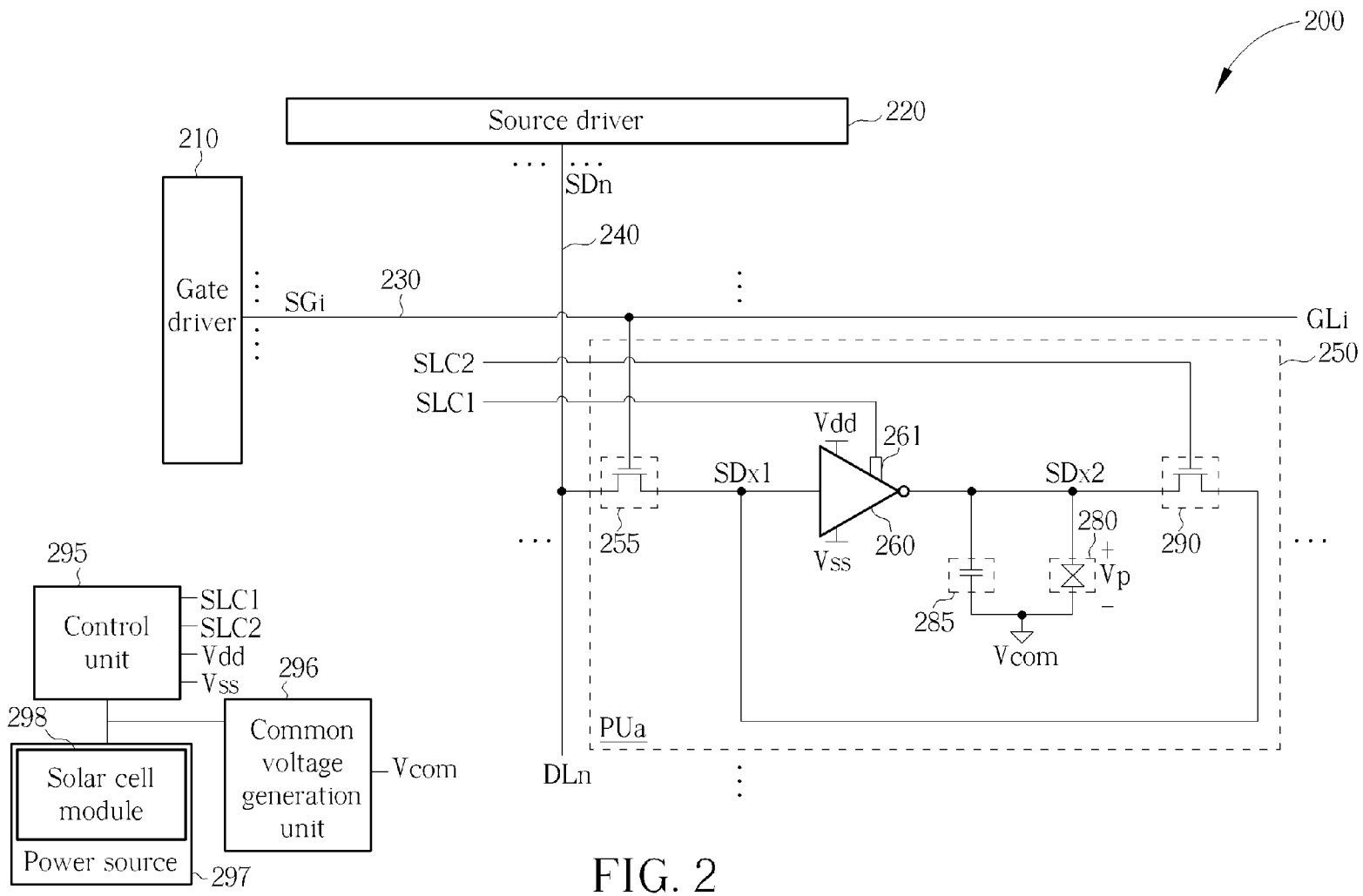
FIG. 2 is a schematic diagram showing a liquid crystal display in accordance with a first embodiment of the present invention.

FIG. 2 is a schematic diagram showing a liquid crystal display 200 in accordance with a first embodiment of the present invention. The liquid crystal display 200 is preferable to be a transflective-mode LCD or a reflective-mode LCD. However, the liquid crystal display 200 may be a transmission-mode LCD. As shown in FIG. 2, the liquid crystal display 200 comprises a gate driver 210, a source driver 220, a plurality of gate lines 230, a plurality of data lines 240, a plurality of pixel units 250, a control unit 295, a common voltage generation unit 296, and a power source 297. In one embodiment, the pixel units 250 may comprise plural red pixel units, plural green pixel units and plural blue pixel units. For ease of explanation, the liquid crystal display 200 illustrates a gate line GLi of the gate lines 230, a data line DLn of the data lines 240, and a pixel unit PUa of the pixel units 250. The pixel unit PUa may be a red pixel unit, a green pixel unit, or a blue pixel unit. The gate line GLi is electrically connected to the gate driver 210 and functions to deliver a gate signal SGi. The data line DLn is electrically connected to the source driver 220 and functions to deliver a data signal SDn. The control unit 295 comprises a first signal output end for outputting a first control signal SLC1, a second signal output end for outputting a second control signal SLC2, a first voltage output end for outputting a first power voltage Vdd, and a second voltage output end for outputting a second power voltage Vss. The first control signal SLC1, the second control signal SLC2, the first power voltage Vdd and the second power voltage Vss are all furnished to each pixel unit 250 so that the liquid crystal display 200 is able to perform a still mode operation accordingly.

The common voltage generation unit 296 comprises an output end for outputting a common voltage Vcom furnished to each pixel unit 250. The common voltage Vcom can be a direct-current (DC) voltage or an alternating-current (AC) voltage. The power source 297, electrically connected to the control unit 295 and the common voltage generation unit 296, is utilized for powering the control unit 295 and the common voltage generation unit 296. The power source 297 comprises a solar cell module 298 which is used to perform an energy conversion operation for powering the control unit 295 and the common voltage generation unit 296. If the electrical energy generated by the solar cell module 298 is insufficient to power the control unit 295 and the common voltage generation unit 296, the control unit 295 and the common voltage generation unit 296 are powered by the other power supply (not shown) of the power source 297. The pixel unit PUa comprises a data switch 255, a voltage-control inverter 260, a liquid crystal capacitor 280, a storage capacitor 285 and a pass transistor 290. The data switch 255 provides a control of inputting the data signal SDn to become a first data signal SDx1 according to the gate signal SGi. The data switch 255 comprises a first end electrically connected to the data line DLn for receiving the data signal SDn, a gate end electrically connected to the gate line GLi for receiving the gate signal SGi, and a second end electrically connected to the voltage-control inverter 260 and the pass transistor 290. The data switch 255 can be a thin film transistor or a field effect transistor. The voltage-control inverter 260 is enabled by the first control signal SLC1 so as to invert the first data signal SDx1 for generating a second data signal SDx2. The voltage-control inverter 260 comprises an input end electrically connected to the second end of the data switch 255, an enable end 261 electrically connected to the first signal output end of the control unit 295 for receiving the first control signal SLC1, an output end electrically connected to the liquid crystal capacitor 280, the storage capacitor 285 and the pass transistor 290, a first power input end electrically connected to the first voltage output end of the control unit 295 for receiving the first power voltage Vdd, and a second power input end electrically connected to the second voltage output end of the control unit 295 for receiving the second power voltage Vss.

The liquid crystal capacitor 280 comprises a first end electrically connected to the output end of the voltage-control inverter 260 and a second end electrically connected to the output end of the common voltage generation unit 296 for receiving the common voltage Vcom. The liquid crystal capacitor 280 provides a liquid crystal voltage Vp based on the second data signal SDx2 and the common voltage Vcom. And the liquid crystal voltage Vp is used to control the liquid-crystal transmittance of the pixel unit PUa. The storage capacitor 285, electrically connected between the first and second ends of the liquid crystal capacitor 280, is employed to assist in storing the second data signal SDx2. The pass transistor 290 is employed to control an electrical connection between the input and output ends of the voltage-control inverter 260 according to the second control signal SLC2. That is, the pass transistor 290 is put in use for providing a control of passing the second data signal SDx2 to become the first data signal SDx1 or passing the first data signal SDx1 to become the second data signal SDx2. The pass transistor 290 comprises a first end electrically connected to the output end of the voltage-control inverter 260, a gate end electrically connected to the second signal output end of the control unit 295 for receiving the second control signal SLC2, and a second end electrically connected to the input end of the voltage-control inverter 260. The pass transistor 290 can be a thin film transistor or a field effect transistor.

After the liquid crystal display 200 enters a still mode for displaying a still frame, each pixel unit 250 is able to perform a pixel data self-retaining operation by making use of the voltage-control inverter 260 and the pass transistor 290 therein. In addition, although the voltage level of the second data signal SDx2 may drift around, which causes the liquid crystal voltage Vp to drift as well, the voltage level of the second data signal SDx2 can be refreshed to become the first power voltage Vdd or the second power voltage Vss through an inversion operation of the voltage-control inverter 260. That is, the inversion operation of the voltage-control inverter 260 can also be employed to provide a data self-refreshing functionality for refreshing the second data signal SDx2. Compared with the pixel unit based on SRAM architecture in the prior-art liquid crystal display, the circuit structure of each pixel unit 250 in the liquid crystal display 200 is significantly simplified to increase the aperture ratio of each pixel unit 250 and also to bring the cost down.

Figure 3:
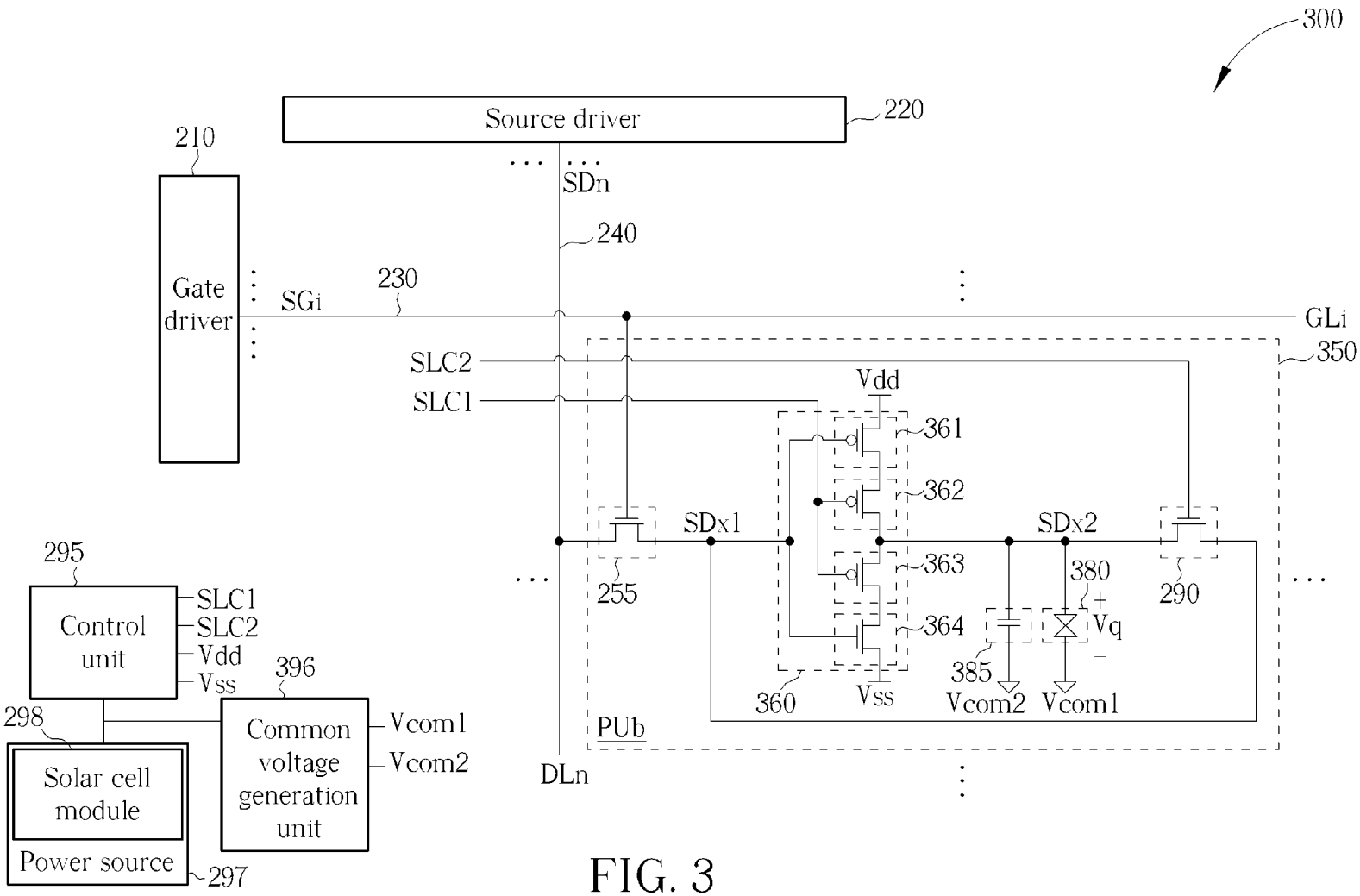
FIG. 3 is a schematic diagram showing a liquid crystal display in accordance with a second embodiment of the present invention.

FIG. 3 is a schematic diagram showing a liquid crystal display 300 in accordance with a second embodiment of the present invention. As shown in FIG. 3, the circuit structure of the liquid crystal display 300 is similar to that of the liquid crystal display 200 shown in FIG. 2, differing in that the common voltage generation unit 296 is replaced with a common voltage generation unit 396 and the pixel units 250 are replaced with a plurality of pixel units 350, wherein the pixel unit PUa is replaced with a pixel unit PUb. The pixel unit Pub may be a red pixel unit, a green pixel unit, or a blue pixel unit. The pixel unit Pub comprises the data switch 255, a voltage-control inverter 360, a liquid crystal capacitor 380, a storage capacitor 385 and the pass transistor 290. The voltage-control inverter 360 comprises a first transistor 361, a second transistor 362, a third transistor 363 and a fourth transistor 364. The second transistor 362 and the third transistor 363 are put in use together for enabling/disabling the circuit output operation of the voltage-control inverter 360 according to the first control signal SLC1. The first transistor 361, the second transistor 362 and the third transistor 363 are P-type thin film transistors or P-type field effect transistors. The fourth transistor 364 and the pass transistor 290 are N-type thin film transistors or N-type field effect transistors. The common voltage generation unit 396 comprises a first output end for outputting a first common voltage Vcom1 and a second output end for outputting a second common voltage Vcom2. The first common voltage Vcom1 and the second common voltage Vcom2 can be DC voltages or AC voltages.

The first transistor 361 comprises a first end electrically connected to the first voltage output end of the control unit 295 for receiving the first power voltage Vdd, a gate end electrically connected to the second end of the data switch 255, and a second end. The second transistor 362 comprises a first end electrically connected to the second end of the first transistor 361, a gate end electrically connected to the first signal output end of the control unit 295 for receiving the first control signal SLC1, and a second end electrically connected to the liquid crystal capacitor 380, the storage capacitor 385 and the first end of the pass transistor 290. The third transistor 363 comprises a first end electrically connected to the second end of the second transistor 362, a gate end electrically connected to the gate end of the second transistor 362, and a second end. It is noted that the gate ends of the second transistor 362 and the third transistor 363 are functioning as an enable end of the voltage-control inverter 360. The fourth transistor 364 comprises a first end electrically connected to the second end of the third transistor 363, a gate end electrically connected to the gate end of the first transistor 361, and a second end electrically connected to the second voltage output end of the control unit 295 for receiving the second power voltage Vss. The liquid crystal capacitor 380 comprises a first end electrically connected to the second end of the second transistor 362 and a second end electrically connected to the first output end of the common voltage generation unit 396 for receiving the first common voltage Vcom1. The liquid crystal capacitor 380 provides a liquid crystal voltage Vq based on the second data signal SDx2 and the first common voltage Vcom1. And the liquid crystal voltage Vq is used to control the liquid-crystal transmittance of the pixel unit Pub. The storage capacitor 385 comprises a first end electrically connected to the first end of the liquid crystal capacitor 380 and a second end electrically connected to the second output end of the common voltage generation unit 396 for receiving the second common voltage Vcom2. The storage capacitor 385 is employed to assist in storing the second data signal SDx2.

Figure 4:
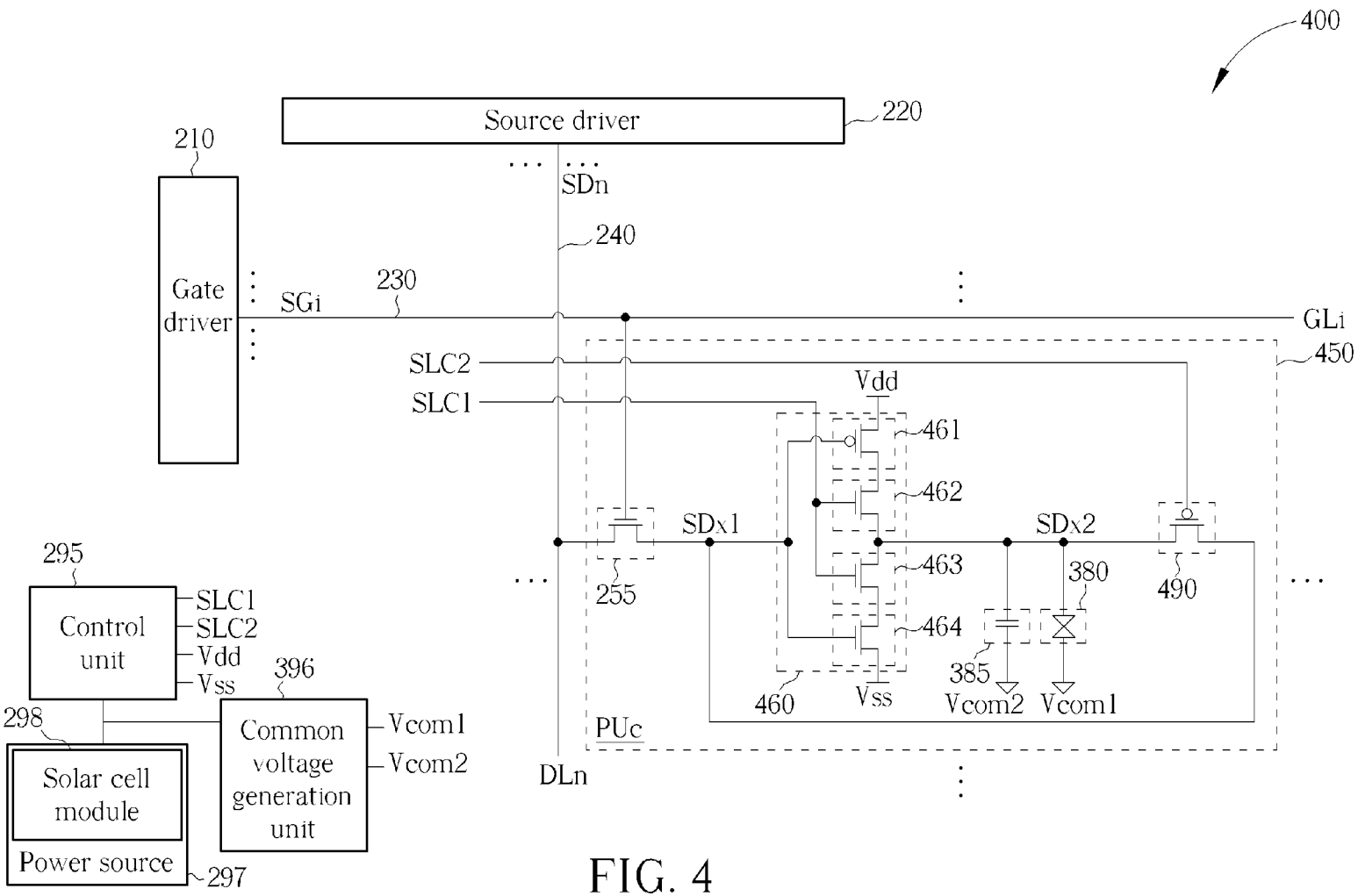
FIG. 4 is a schematic diagram showing a liquid crystal display in accordance with a third embodiment of the present invention.

FIG. 4 is a schematic diagram showing a liquid crystal display 400 in accordance with a third embodiment of the present invention. As shown in FIG. 4, the circuit structure of the liquid crystal display 400 is similar to that of the liquid crystal display 300 shown in FIG. 3, differing in that the pixel units 350 are replaced with a plurality of pixel units 450, wherein the pixel unit PUb is replaced with a pixel unit PUc. The pixel unit PUc may be a red pixel unit, a green pixel unit, or a blue pixel unit. The pixel unit PUc comprises the data switch 255, a voltage-control inverter 460, the liquid crystal capacitor 380, the storage capacitor 385 and a pass transistor 490. The voltage-control inverter 460 comprises a first transistor 461, a second transistor 462, a third transistor 463 and a fourth transistor 464. The second transistor 462 and the third transistor 463 are put in use together for enabling/disabling the circuit output operation of the voltage-control inverter 460 according to the first control signal SLC1. The first transistor 461 and the pass transistor 490 are P-type thin film transistors or P-type field effect transistors. The second transistor 462, the third transistor 463 and the fourth transistor 464 are N-type thin film transistors or N-type field effect transistors. The pass transistor 490 comprises a first end electrically connected to the first end of the liquid crystal capacitor 380, a gate end electrically connected to the second signal output end of the control unit 295 for receiving the second control signal SLC2, and a second end electrically connected to the second end of the data switch 255.

The first transistor 461 comprises a first end electrically connected to the first voltage output end of the control unit 295 for receiving the first power voltage Vdd, a gate end electrically connected to the second end of the data switch 255, and a second end. The second transistor 462 comprises a first end electrically connected to the second end of the first transistor 461, a gate end electrically connected to the first signal output end of the control unit 295 for receiving the first control signal SLC1, and a second end electrically connected to the liquid crystal capacitor 380, the storage capacitor 385 and the first end of the pass transistor 490. The third transistor 463 comprises a first end electrically connected to the second end of the second transistor 462, a gate end electrically connected to the gate end of the second transistor 462, and a second end. It is noted that the gate ends of the second transistor 462 and the third transistor 463 are functioning as an enable end of the voltage-control inverter 460. The fourth transistor 464 comprises a first end electrically connected to the second end of the third transistor 463, a gate end electrically connected to the gate end of the first transistor 461, and a second end electrically connected to the second voltage output end of the control unit 295 for receiving the second power voltage Vss.

Figure 5:
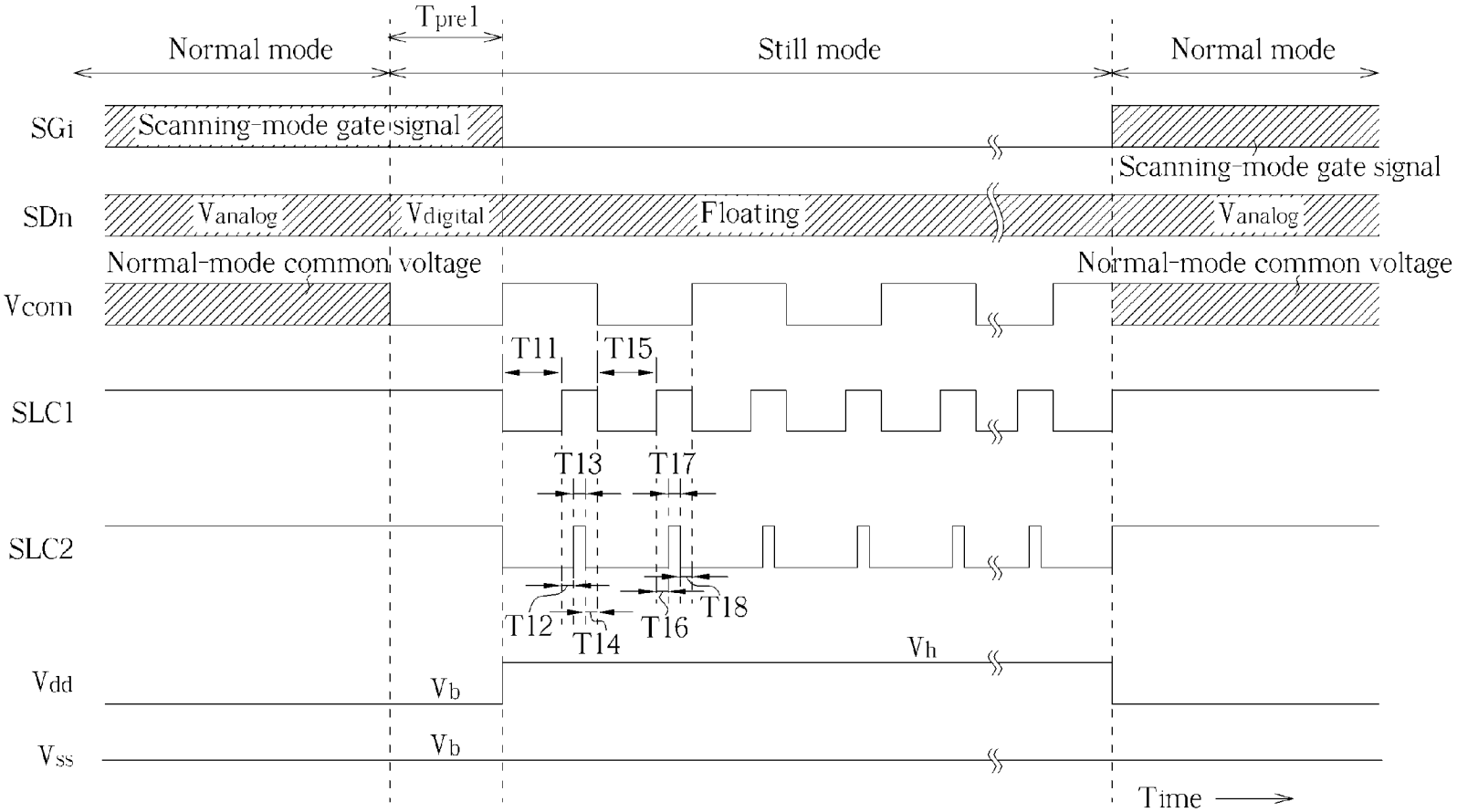
FIG. 5 is a schematic diagram showing related signal waveforms regarding a first circuit operation case of the liquid crystal display shown in FIG. 2, having time along the abscissa.

FIG. 5 is a schematic diagram showing related signal waveforms regarding a first circuit operation case of the liquid crystal display 200 shown in FIG. 2, having time along the abscissa. The signal waveforms in FIG. 5, from top to bottom, are the gate signal SGi, the data signal SDn, the common voltage Vcom, the first control signal SLC1, the second control signal SLC2, the first power voltage Vdd, and the second power voltage Vss. When the liquid crystal display 200 is working in a normal mode, the data signal SDn provided by the source driver 220 is a multi-level analog voltage Vanalog, the gate driver 210 provides the gate signal SGi based on a normal scanning mode, the data switch 255 inputs the data signal SDn to become the first data signal SDx1 according to the gate signal SGi under the normal scanning mode, the common voltage Vcom provided by the common voltage generation unit 296 is an AC voltage or a DC voltage required for normal-mode operation, the control unit 295 provides the first control signal SLC1 having high voltage level for disabling the voltage-control inverter 260, the control unit 295 provides the second control signal SLC2 having high voltage level so as to turn on the pass transistor 290 for passing the first data signal SDx1 to become the second data signal SDx2, and both the first power voltage Vdd and the second power voltage Vss generated by the control unit 295 are low voltage Vb.

After the liquid crystal display 200 enters a still mode for displaying a still frame, during a preliminary interval Tpre1, the data signal SDn provided by the source driver 220 is a bi-level digital voltage Vdigital, the data switch 255 inputs the bi-level digital voltage Vdigital to become the first data signal SDx1 according to the gate signal SGi under the normal scanning mode, the common voltage generation unit 296 provides the common voltage Vcom having a first voltage level, the control unit 295 provides the first control signal SLC1 having high voltage level so as to continue disabling the voltage-control inverter 260, the control unit 295 provides the second control signal SLC2 having high voltage level so as to continue turning on the pass transistor 290 and thereby to continue passing the first data signal SDx1 to become the second data signal SDx2, and both the first power voltage Vdd and the second power voltage Vss generated by the control unit 295 hold low voltage Vb. It is noted that the second data signal SDx2 is then becoming the bi-level digital voltage Vdigital. Besides, the gate driver 210 is turned off after the data switch 255 inputs the bi-level digital voltage Vdigital to become the first data signal SDx1. Further, the source driver 220 is turned off after the gate driver 210 is turned off and thus the data signal SDn becomes a floating voltage.

During a first still interval T11, the common voltage generation unit 296 switches the voltage level of the common voltage Vcom from the first voltage level to a second voltage level. The control unit 295 switches the first power voltage Vdd from low voltage Vb to high voltage Vh. The control unit 295 provides the second control signal SLC2 having low voltage level for turning off the pass transistor 290. The control unit 295 provides the first control signal SLC1 having low voltage level so as to enable the voltage-control inverter 260 for inverting the first data signal SDx1 to generate the second data signal SDx2 which is furnished to the liquid crystal capacitor 280. During a second still interval T12, the control unit 295 provides the first control signal SLC1 having high voltage level and the second control signal SLC2 having low voltage level for disabling the voltage-control inverter 260 and for turning off the pass transistor 290 respectively. During a third still interval T13, the control unit 295 provides the first control signal SLC1 having high voltage level for disabling the voltage-control inverter 260. And the control unit 295 provides the second control signal SLC2 having high voltage level so as to turn on the pass transistor 290 for passing the second data signal SDx2 to become the first data signal SDx1. During a fourth still interval T14, the control unit 295 provides the first control signal SLC1 having high voltage level and the second control signal SLC2 having low voltage level for disabling the voltage-control inverter 260 and for turning off the pass transistor 290 respectively. It is noted that the falling edge of the first control signal SLC1 is not required to align the falling/rising edge of the common voltage Vcom.

The circuit operations during a fifth still interval T15, a sixth still interval T16, a seventh still interval T17 and an eighth still interval T18 are similar to the aforementioned circuit operations during the first still interval T11, the second still interval T12, the third still interval T13 and the fourth still interval T14 respectively, differing only in that the common voltage generation unit 296 switches the voltage level of the common voltage Vcom from the second voltage level to the first voltage level. In another embodiment, after entering the still mode, the common voltage generation unit 296 may provide the common voltage Vcom having fixed voltage level. After the eighth still interval T18, as long as the operation of the still mode continues, the liquid crystal display 200 performs the aforementioned circuit operations of the first through eighth still intervals T11~T18 periodically and repetitively. When the liquid crystal display 200 ceases the operation of the still mode, the operation of the liquid crystal display 200 may return to the normal mode. If the operation of the liquid crystal display 200 changes from the still mode to the normal mode after disabling the voltage-control inverter 260 and turning on the pass transistor 290 which are corresponding to the circuit operations during the third still interval T13, the control unit 295 switches the first power voltage Vdd from high voltage Vh to low voltage Vb, the source driver 220 is turned on for providing the data signal SDn having the multi-level analog voltage Vanalog, the gate driver 210 is turned on for providing the gate signal SGi based on the normal scanning mode, and the common voltage Vcom provided by the common voltage generation unit 296 returns to the AC or DC voltage required for normal-mode operation. If the common voltage Vcom in FIG. 5 is replaced with the first and second common voltages Vcom1/Vcom2, the signal waveforms illustrated in FIG. 5 can be applied to make clear the operation of the liquid crystal display 300 shown in FIG. 3.

Figure 6:
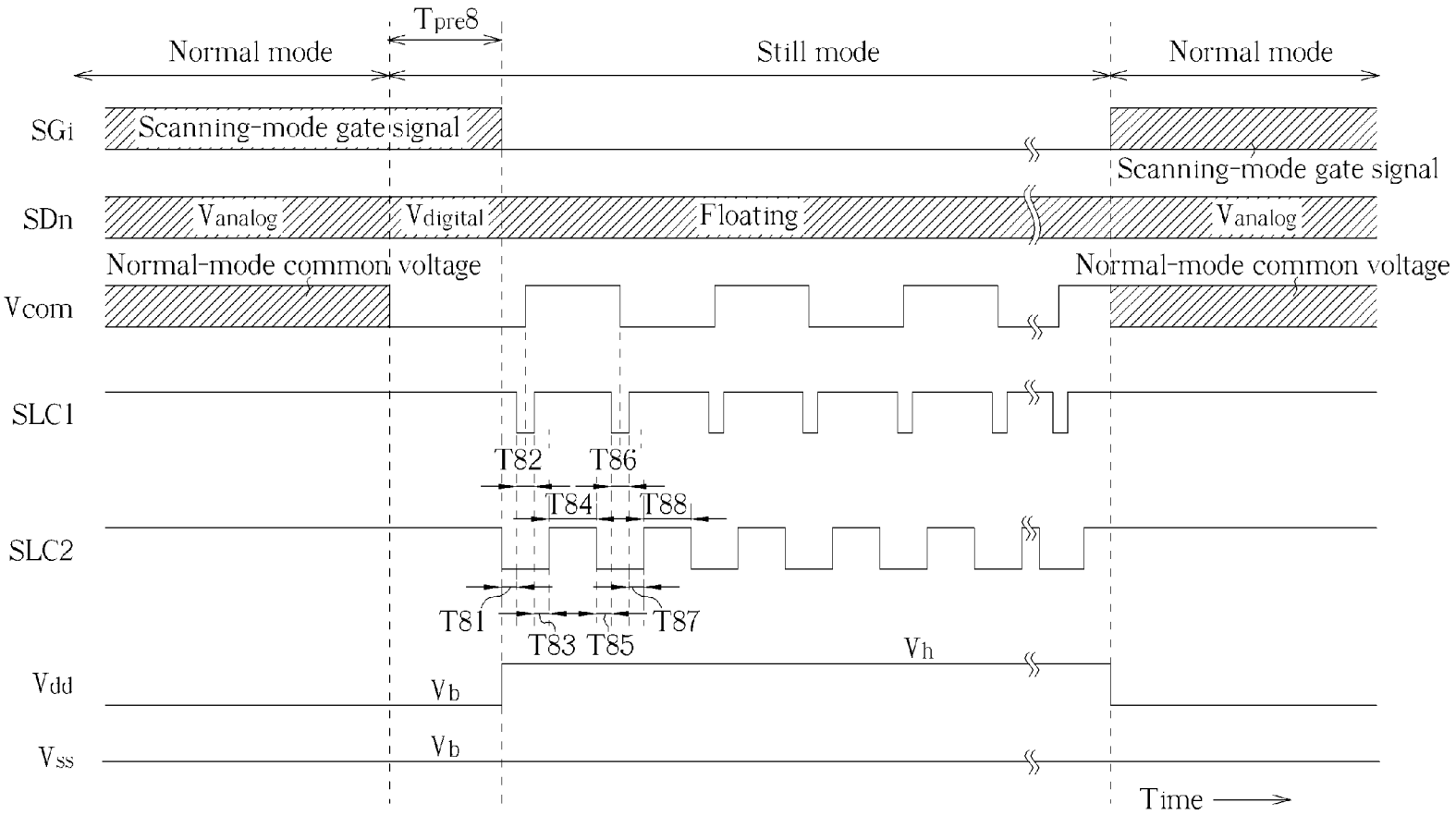
FIG. 6 is a schematic diagram showing related signal waveforms regarding a second circuit operation case of the liquid crystal display shown in FIG. 2, having time along the abscissa.

FIG. 6 is a schematic diagram showing related signal waveforms regarding the second circuit operation case of the liquid crystal display 200 shown in FIG. 2, having time along the abscissa. The signal waveforms in FIG. 6, from top to bottom, are the gate signal SGi, the data signal SDn, the common voltage Vcom, the first control signal SLC1, the second control signal SLC2, the first power voltage Vdd, and the second power voltage Vss. When the liquid crystal display 200 is working in a normal mode or during a preliminary interval Tpre8 under a still mode, the signal waveforms shown in FIG. 6 are identical to the signal waveforms of the first circuit operation case illustrated in FIG. 5, and for the sake of brevity, further similar discussion thereof is omitted.

During a fourth still interval T81 under the still mode, the common voltage generation unit 296 still provides the common voltage Vcom having the first voltage level. The control unit 295 switches the first power voltage Vdd from low voltage Vb to high voltage Vh. The control unit 295 provides the first control signal SLC1 having high voltage level and the second control signal SLC2 having low voltage level for disabling the voltage-control inverter 260 and for turning off the pass transistor 290 respectively. It is noted that the rising edge of the first power voltage Vdd is required only to occur before the first falling edge of the first control signal SLC1 after entering the still mode, i.e. the rising edge of the first power voltage Vdd is not required to align the falling edge of the second control signal SLC2.

During a first still interval T82 under the still mode, the control unit 295 provides the second control signal SLC2 having low voltage level for turning off the pass transistor 290. The control unit 295 provides the first control signal SLC1 having low voltage level so as to enable the voltage-control inverter 260 for inverting the first data signal SDx1 to generate the second data signal SDx2 which is furnished to the liquid crystal capacitor 280. And the common voltage generation unit 296 switches the voltage level of the common voltage Vcom from the first voltage level to the second voltage level. The rising/falling edge of the common voltage Vcom is not required to align the rising/falling edge of the first control signal SLC1. During a second still interval T83 under the still mode, the control unit 295 provides the first control signal SLC1 having high voltage level and the second control signal SLC2 having low voltage level for disabling the voltage-control inverter 260 and for turning off the pass transistor 290 respectively. During a third still interval T84 under the still mode, the control unit 295 provides the first control signal SLC1 having high voltage level for disabling the voltage-control inverter 260. And the control unit 295 provides the second control signal SLC2 having high voltage level so as to turn on the pass transistor 290 for passing the second data signal SDx2 to become the first data signal SDx1. It is noted that the fourth still interval T81 is followed by the first, second and third intervals T82~T84 sequentially.

The circuit operations during plural still intervals T85, T86, T87 and T88 are similar to the aforementioned circuit operations during the fourth still interval T81, the first still interval T82, the second still interval T83 and the third still interval T84 respectively, differing only in that the common voltage generation unit 296 switches the voltage level of the common voltage Vcom from the second voltage level to the first voltage level during the still interval T86. In another embodiment, after entering the still mode, the common voltage generation unit 296 may provide the common voltage Vcom having fixed voltage level. After the still interval T88, as long as the operation of the still mode continues, the liquid crystal display 200 performs the aforementioned circuit operations of the still intervals T81~T88 periodically and repetitively. When the liquid crystal display 200 ceases the operation of the still mode, the operation of the liquid crystal display 200 may change from the still mode to the normal mode after disabling the voltage-control inverter 260 and turning on the pass transistor 290 which are corresponding to the circuit operations during the third still interval T84, and the corresponding signal waveforms thereof shown in FIG. 6 are identical to those of the first circuit operation case illustrated in FIG. 5. Similarly, if the common voltage Vcom in FIG. 6 is replaced with the first and second common voltages Vcom1/Vcom2, the signal waveforms illustrated in FIG. 6 can be applied to make clear the operation of the liquid crystal display 300 shown in FIG. 3.

Figure 7:
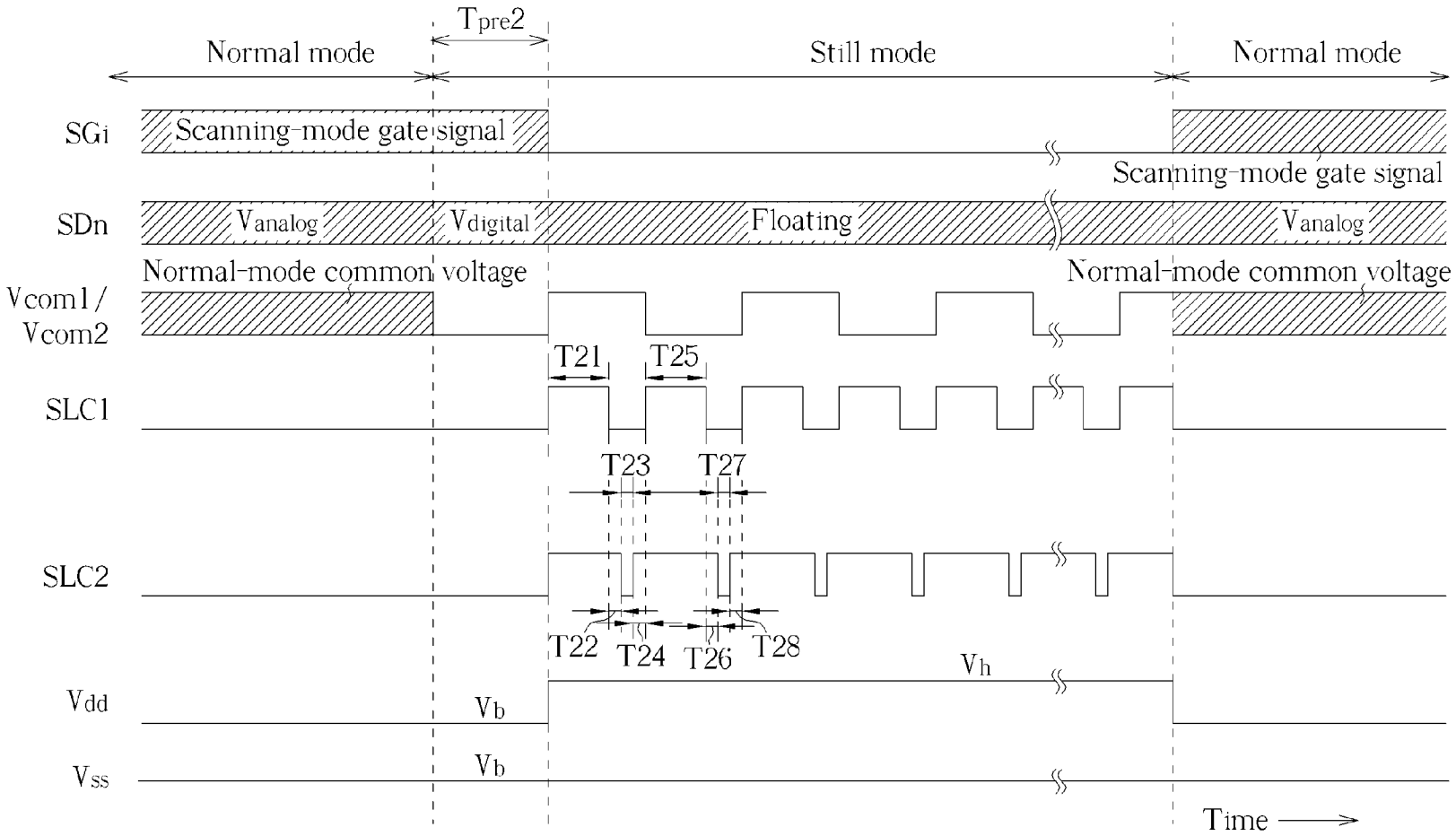
FIG. 7 is a schematic diagram showing related signal waveforms regarding the circuit operation of the liquid crystal display shown in FIG. 4, having time along the abscissa.

FIG. 7 is a schematic diagram showing related signal waveforms regarding the circuit operation of the liquid crystal display 400 shown in FIG. 4, having time along the abscissa. The signal waveforms in FIG. 7, from top to bottom, are the gate signal SGi, the data signal SDn, the first and second common voltages Vcom1/Vcom2, the first control signal SLC1, the second control signal SLC2, the first power voltage Vdd, and the second power voltage Vss. When the liquid crystal display 400 is working in a normal mode, the data signal SDn provided by the source driver 220 is a multi-level analog voltage Vanalog, the gate driver 210 provides the gate signal SGi based on a normal scanning mode, the data switch 255 inputs the data signal SDn to become the first data signal SDx1 according to the gate signal SGi under the normal scanning mode, the first and second common voltages Vcom1/Vcom2 provided by the common voltage generation unit 396 are AC or DC voltages required for normal-mode operation, the control unit 295 provides the first control signal SLC1 having low voltage level for disabling the voltage-control inverter 460, the control unit 295 provides the second control signal SLC2 having low voltage level so as to turn on the pass transistor 490 for passing the first data signal SDx1 to become the second data signal SDx2, and both the first power voltage Vdd and the second power voltage Vss generated by the control unit 295 are low voltage Vb.

After the liquid crystal display 400 enters a still mode for displaying a still frame, during a preliminary interval Tpre2, the data signal SDn provided by the source driver 220 is a bi-level digital voltage Vdigital, the data switch 255 inputs the bi-level digital voltage Vdigital to become the first data signal SDx1 according to the gate signal SGi under the normal scanning mode, the common voltage generation unit 396 provides the first and second common voltages Vcom1/Vcom2 having a first voltage level, the control unit 295 provides the first control signal SLC1 having low voltage level so as to continue disabling the voltage-control inverter 460, the control unit 295 provides the second control signal SLC2 having low voltage level so as to continue turning on the pass transistor 490 and thereby to continue passing the first data signal SDx1 to become the second data signal SDx2, and both the first power voltage Vdd and the second power voltage Vss generated by the control unit 295 hold low voltage Vb. Besides, the gate driver 210 is turned off after the data switch 255 inputs the bi-level digital voltage Vdigital to become the first data signal SDx1. Further, the source driver 220 is turned off after the gate driver 210 is turned off and thus the data signal SDn becomes a floating voltage.

During a first still interval T21, the common voltage generation unit 396 switches the voltage level of the first and second common voltages Vcom1/Vcom2 from the first voltage level to a second voltage level. The control unit 295 switches the first power voltage Vdd from low voltage Vb to high voltage Vh. The control unit 295 provides the second control signal SLC2 having high voltage level for turning off the pass transistor 490. And the control unit 295 provides the first control signal SLC1 having high voltage level so as to enable the voltage-control inverter 460 for inverting the first data signal SDx1 to generate the second data signal SDx2 which is furnished to the liquid crystal capacitor 380. During a second still interval T22, the control unit 295 provides the first control signal SLC1 having low voltage level and the second control signal SLC2 having high voltage level for disabling the voltage-control inverter 460 and for turning off the pass transistor 490 respectively. During a third still interval T23, the control unit 295 provides the first control signal SLC1 having low voltage level for disabling the voltage-control inverter 460. And the control unit 295 provides the second control signal SLC2 having low voltage level so as to turning on the pass transistor 490 for passing the second data signal SDx2 to become the first data signal SDx1. During a fourth still interval T24, the control unit 295 provides the first control signal SLC1 having low voltage level and the second control signal SLC2 having high voltage level for disabling the voltage-control inverter 460 and for turning off the pass transistor 490 respectively. It is noted that the rising edge of the first control signal SLC1 is not required to align the falling/rising edge of the first and second common voltages Vcom1/Vcom2.

The circuit operations during a fifth still interval T25, a sixth still interval T26, a seventh still interval T27 and an eighth still interval T28 are similar to the aforementioned circuit operations during the first still interval T21, the second still interval T22, the third still interval T23 and the fourth still interval T24 respectively, differing only in that the common voltage generation unit 396 switches the voltage level of the first and second common voltages Vcom1/Vcom2 from the second voltage level to the first voltage level. In another embodiment, after entering the still mode, the common voltage generation unit 396 may provide the first and second common voltages Vcom1/Vcom2 having fixed voltage level. After the eighth still interval T28, as long as the operation of the still mode continues, the liquid crystal display 400 performs the aforementioned circuit operations of the first through eighth still intervals T21~T28 periodically and repetitively. When the liquid crystal display 400 ceases the operation of the still mode, the liquid crystal display 400 may return to the normal mode. If the operation of the liquid crystal display 400 changes from the still mode to the normal mode, the control unit 295 switches the first power voltage Vdd from high voltage Vh to low voltage Vb, the source driver 220 is turned on for providing the data signal SDn having the multi-level analog voltage Vanalog, the gate driver 210 is turned on for providing the gate signal SGi based on the normal scanning mode, and the first and second common voltages Vcom1/Vcom2 provided by the common voltage generation unit 396 return to the AC or DC voltages required for normal-mode operation.

Figure 8:
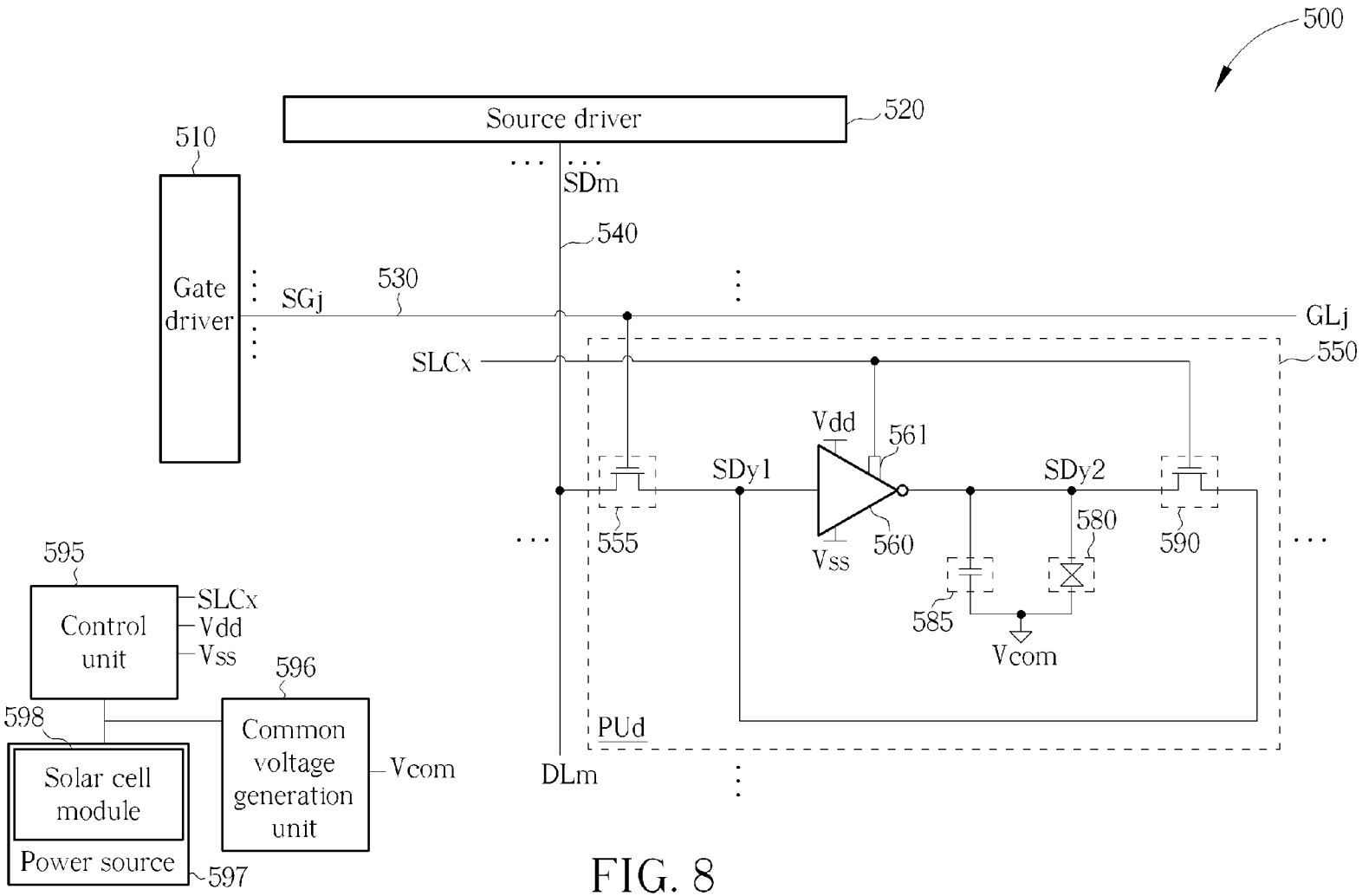
FIG. 8 is a schematic diagram showing a liquid crystal display in accordance with a fourth embodiment of the present invention.

FIG. 8 is a schematic diagram showing a liquid crystal display 500 in accordance with a fourth embodiment of the present invention. The liquid crystal display 500 is preferable to be a transflective-mode LCD or a reflective-mode LCD. However, the liquid crystal display 500 may be a transmission-mode LCD. As shown in FIG. 8, the liquid crystal display 500 comprises a gate driver 510, a source driver 520, a plurality of gate lines 530, a plurality of data lines 540, a plurality of pixel units 550, a control unit 595, a common voltage generation unit 596, and a power source 597. In one embodiment, the pixel units 550 may comprise plural red pixel units, plural green pixel units and plural blue pixel units. For ease of explanation, the liquid crystal display 500 illustrates a gate line GLj of the gate lines 530, a data line DLm of the data lines 540, and a pixel unit PUd of the pixel units 550. The pixel unit PUd may be a red pixel unit, a green pixel unit, or a blue pixel unit. The gate line GLj is electrically connected to the gate driver 510 and functions to deliver a gate signal SGj. The data line DLm is electrically connected to the source driver 520 and functions to deliver a data signal SDm. The control unit 595 comprises a signal output end for outputting a control signal SLCx, a first voltage output end for outputting a first power voltage Vdd, and a second voltage output end for outputting a second power voltage Vss. The control signal SLCx, the first power voltage Vdd and the second power voltage Vss are all furnished to each pixel unit 550 so that the liquid crystal display 500 is able to perform a still mode operation accordingly. The circuit functionalities of the common voltage generation unit 596 and the power source 597 are respectively identical to the circuit functionalities of the common voltage generation unit 296 and the power source 297 shown in FIG. 2, and for the sake of brevity, further similar discussion thereof is omitted.

The pixel unit PUd comprises a data switch 555, a voltage-control inverter 560, a liquid crystal capacitor 580, a storage capacitor 585 and a pass transistor 590. The data switch 555 provides a control of inputting the data signal SDm to become a first data signal SDy1 according to the gate signal SGj. The data switch 555 comprises a first end electrically connected to the data line DLm for receiving the data signal SDm, a gate end electrically connected to the gate line GLj for receiving the gate signal SGj, and a second end electrically connected to the voltage-control inverter 560 and the pass transistor 590. The data switch 555 can be a thin film transistor or a field effect transistor. The voltage-control inverter 560 is enabled by the control signal SLCx so as to invert the first data signal SDy1 for generating a second data signal SDy2. The voltage-control inverter 560 comprises an input end electrically connected to the second end of the data switch 555, an enable end 561 electrically connected to the signal output end of the control unit 595 for receiving the control signal SLCx, an output end electrically connected to the liquid crystal capacitor 580, the storage capacitor 585 and the pass transistor 590, a first power input end electrically connected to the first voltage output end of the control unit 595 for receiving the first power voltage Vdd, and a second power input end electrically connected to the second voltage output end of the control unit 595 for receiving the second power voltage Vss.

The liquid crystal capacitor 580 comprises a first end electrically connected to the output end of the voltage-control inverter 560 and a second end electrically connected to the output end of the common voltage generation unit 596 for receiving the common voltage Vcom. The storage capacitor 585, electrically connected between the first and second ends of the liquid crystal capacitor 580, is employed to assist in storing the second data signal SDy2. The pass transistor 590 is employed to control an electrical connection between the input and output ends of the voltage-control inverter 560 according to the control signal SLCx. That is, the pass transistor 590 is put in use for providing a control of passing the second data signal SDy2 to become the first data signal SDy1 or passing the first data signal SDy1 to become the second data signal SDy2. The pass transistor 590 comprises a first end electrically connected to the output end of the voltage-control inverter 560, a gate end electrically connected to the signal output end of the control unit 595 for receiving the control signal SLCx, and a second end electrically connected to the input end of the voltage-control inverter 560. The pass transistor 590 can be a thin film transistor or a field effect transistor.

After the liquid crystal display 500 enters a still mode for displaying a still frame, each pixel unit 550 is able to perform a pixel data self-retaining operation by making use of the voltage-control inverter 560 and the pass transistor 590 therein. Besides, the voltage level of the second data signal SDy2 can be refreshed to become the first power voltage Vdd or the second power voltage Vss through an inversion operation of the voltage-control inverter 560. That is, the inversion operation of the voltage-control inverter 560 can also be employed to provide a data self-refreshing functionality for refreshing the second data signal SDy2. Compared with the pixel unit based on SRAM architecture in the prior-art liquid crystal display, the circuit structure of each pixel unit 550 in the liquid crystal display 500 is significantly simplified to increase the aperture ratio of each pixel unit 550 and also to bring the cost down. Compared with the liquid crystal display 200 shown in FIG. 2, only one control signal, i.e. the control signal SLCx, is required for each pixel unit 550 to control the operation of the voltage-control inverter 560 and the pass transistor 590, and therefore the number of connection lines can be reduced for further increasing the aperture ratio of each pixel unit 550.

Figure 9:
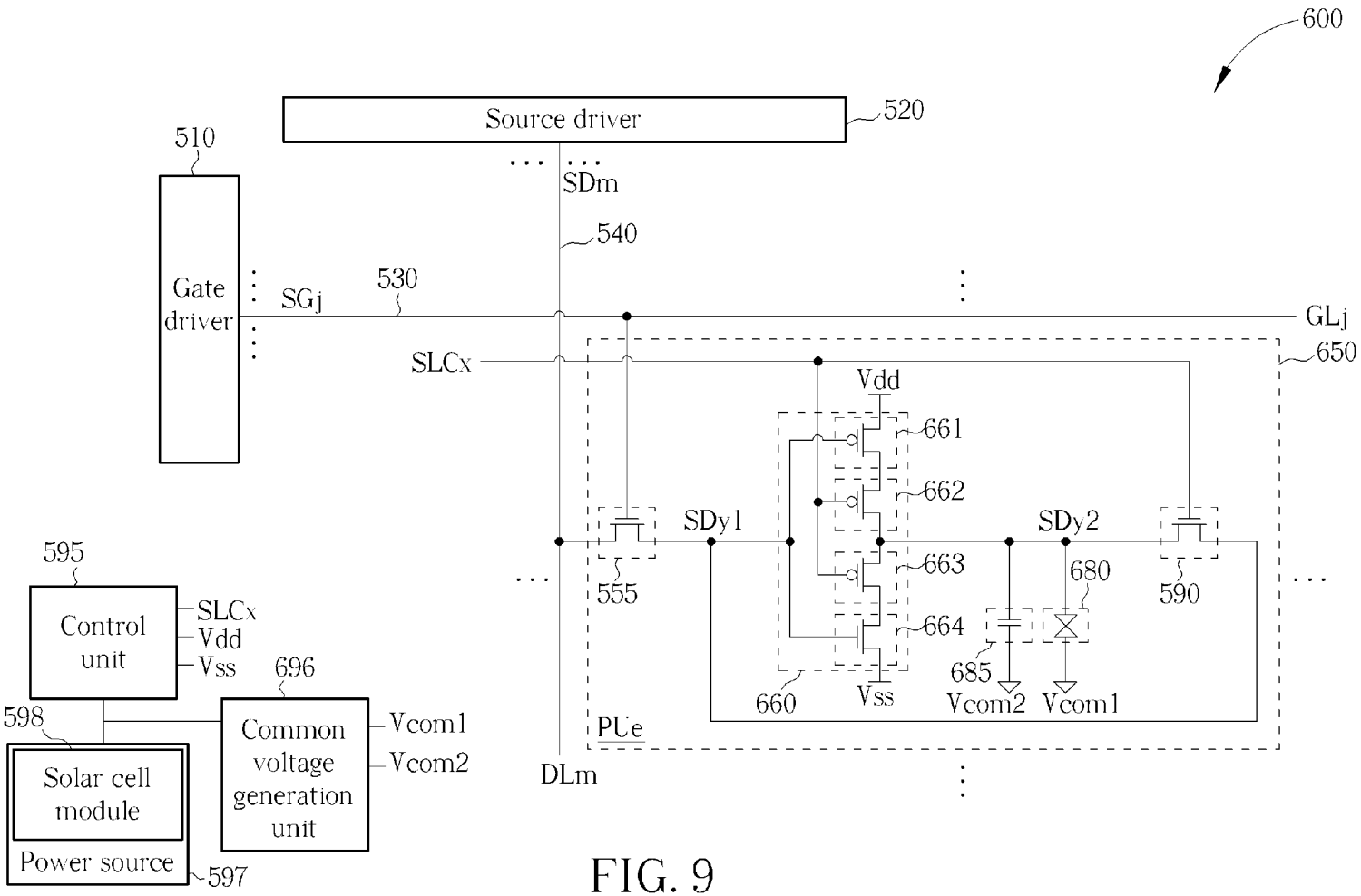
FIG. 9 is a schematic diagram showing a liquid crystal display in accordance with a fifth embodiment of the present invention.

FIG. 9 is a schematic diagram showing a liquid crystal display 600 in accordance with a fifth embodiment of the present invention. As shown in FIG. 9, the circuit structure of the liquid crystal display 600 is similar to that of the liquid crystal display 500 shown in FIG. 8, differing in that the common voltage generation unit 596 is replaced with a common voltage generation unit 696 and the pixel units 550 are replaced with a plurality of pixel units 650, wherein the pixel unit PUd is replaced with a pixel unit PUe. The pixel unit PUe may be a red pixel unit, a green pixel unit, or a blue pixel unit. The pixel unit PUe comprises the data switch 555, a voltage-control inverter 660, a liquid crystal capacitor 680, a storage capacitor 685 and the pass transistor 590. The voltage-control inverter 660 comprises a first transistor 661, a second transistor 662, a third transistor 663 and a fourth transistor 664. The second transistor 662 and the third transistor 663 are put in use together for enabling/disabling the circuit output operation of the voltage-control inverter 660 according to the control signal SLCx. The first transistor 661, the second transistor 662 and the third transistor 663 are P-type thin film transistors or P-type field effect transistors. The fourth transistor 664 and the pass transistor 590 are N-type thin film transistors or N-type field effect transistors. The common voltage generation unit 696 comprises a first output end for outputting a first common voltage Vcom1 and a second output end for outputting a second common voltage Vcom2.

The first transistor 661 comprises a first end electrically connected to the first voltage output end of the control unit 595 for receiving the first power voltage Vdd, a gate end electrically connected to the second end of the data switch 555, and a second end. The second transistor 662 comprises a first end electrically connected to the second end of the first transistor 661, a gate end electrically connected to the signal output end of the control unit 595 for receiving the control signal SLCx, and a second end electrically connected to the liquid crystal capacitor 680, the storage capacitor 685 and the first end of the pass transistor 590. The third transistor 663 comprises a first end electrically connected to the second end of the second transistor 662, a gate end electrically connected to the gate end of the second transistor 662, and a second end. It is noted that the gate ends of the second transistor 662 and the third transistor 663 are functioning as an enable end of the voltage-control inverter 660. The fourth transistor 664 comprises a first end electrically connected to the second end of the third transistor 663, a gate end electrically connected to the gate end of the first transistor 661, and a second end electrically connected to the second voltage output end of the control unit 595 for receiving the second power voltage Vss. The liquid crystal capacitor 680 comprises a first end electrically connected to the second end of the second transistor 662 and a second end electrically connected to the first output end of the common voltage generation unit 696 for receiving the first common voltage Vcom1. The storage capacitor 685 comprises a first end electrically connected to the first end of the liquid crystal capacitor 680 and a second end electrically connected to the second output end of the common voltage generation unit 696 for receiving the second common voltage Vcom2. The storage capacitor 685 is employed to assist in storing the second data signal SDy2.

Figure 10:
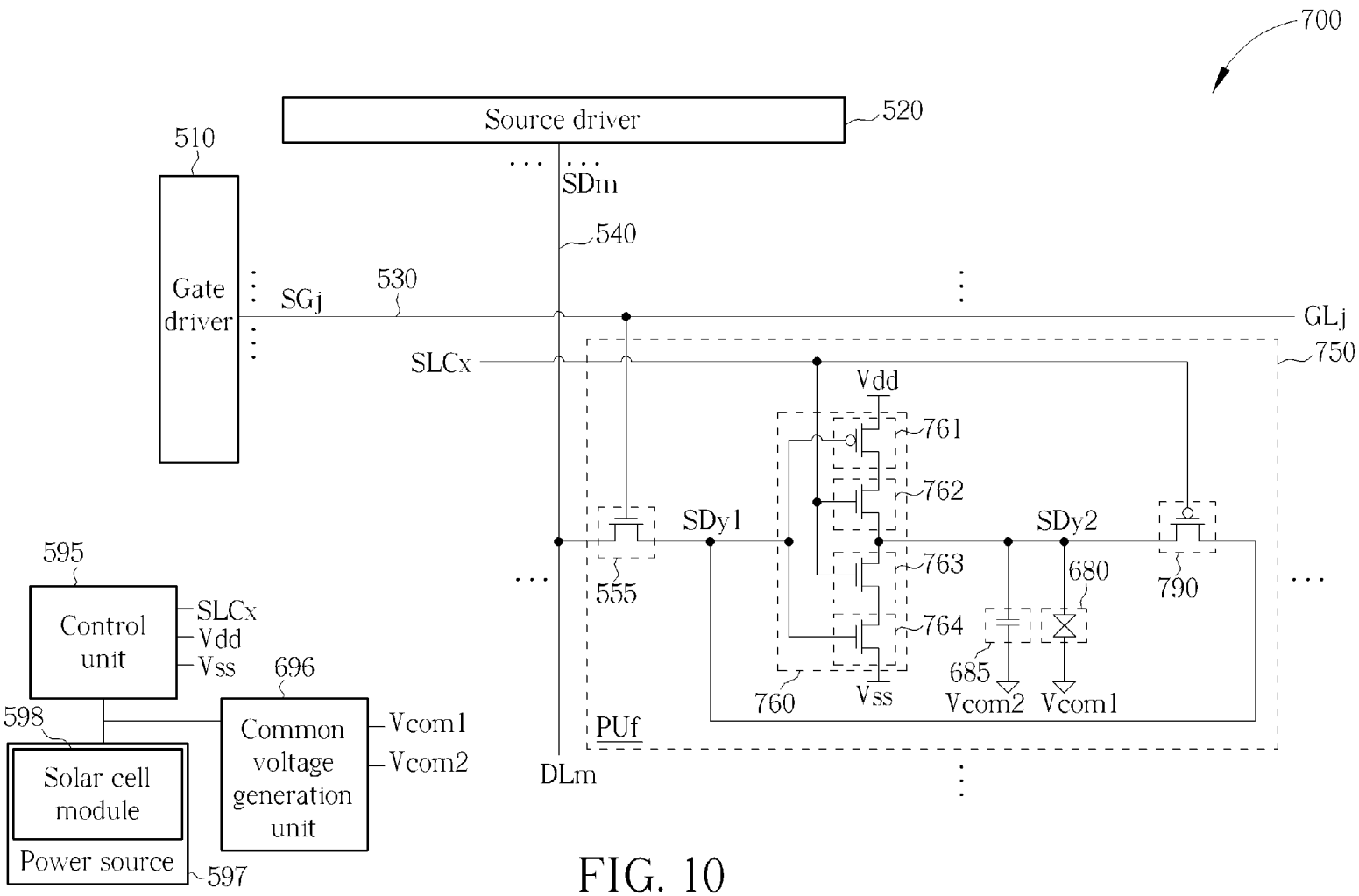
FIG. 10 is a schematic diagram showing a liquid crystal display in accordance with a sixth embodiment of the present invention.

FIG. 10 is a schematic diagram showing a liquid crystal display 700 in accordance with a sixth embodiment of the present invention. As shown in FIG. 10, the circuit structure of the liquid crystal display 700 is similar to that of the liquid crystal display 600 shown in FIG. 9, differing in that the pixel units 650 are replaced with a plurality of pixel units 750, wherein the pixel unit PUe is replaced with a pixel unit PUf. The pixel unit PUf may be a red pixel unit, a green pixel unit, or a blue pixel unit. The pixel unit PUf comprises the data switch 555, a voltage-control inverter 760, the liquid crystal capacitor 680, the storage capacitor 685 and a pass transistor 790. The voltage-control inverter 760 comprises a first transistor 761, a second transistor 762, a third transistor 763 and a fourth transistor 764. The second transistor 762 and the third transistor 763 are put in use together for enabling/disabling the circuit output operation of the voltage-control inverter 760 according to the control signal SLCx. The first transistor 761 and the pass transistor 790 are P-type thin film transistors or P-type field effect transistors. The second transistor 762, the third transistor 763 and the fourth transistor 764 are N-type thin film transistors or N-type field effect transistors. The pass transistor 790 comprises a first end electrically connected to the first end of the liquid crystal capacitor 680, a gate end electrically connected to the signal output end of the control unit 595 for receiving the control signal SLCx, and a second end electrically connected to the second end of the data switch 555.

The first transistor 761 comprises a first end electrically connected to the first voltage output end of the control unit 595 for receiving the first power voltage Vdd, a gate end electrically connected to the second end of the data switch 555, and a second end. The second transistor 762 comprises a first end electrically connected to the second end of the first transistor 761, a gate end electrically connected to the signal output end of the control unit 595 for receiving the control signal SLCx, and a second end electrically connected to the liquid crystal capacitor 680, the storage capacitor 685 and the first end of the pass transistor 790. The third transistor 763 comprises a first end electrically connected to the second end of the second transistor 762, a gate end electrically connected to the gate end of the second transistor 762, and a second end. It is noted that the gate ends of the second transistor 762 and the third transistor 763 are functioning as an enable end of the voltage-control inverter 760. The fourth transistor 764 comprises a first end electrically connected to the second end of the third transistor 763, a gate end electrically connected to the gate end of the first transistor 761, and a second end electrically connected to the second voltage output end of the control unit 595 for receiving the second power voltage Vss.

Figure 11:
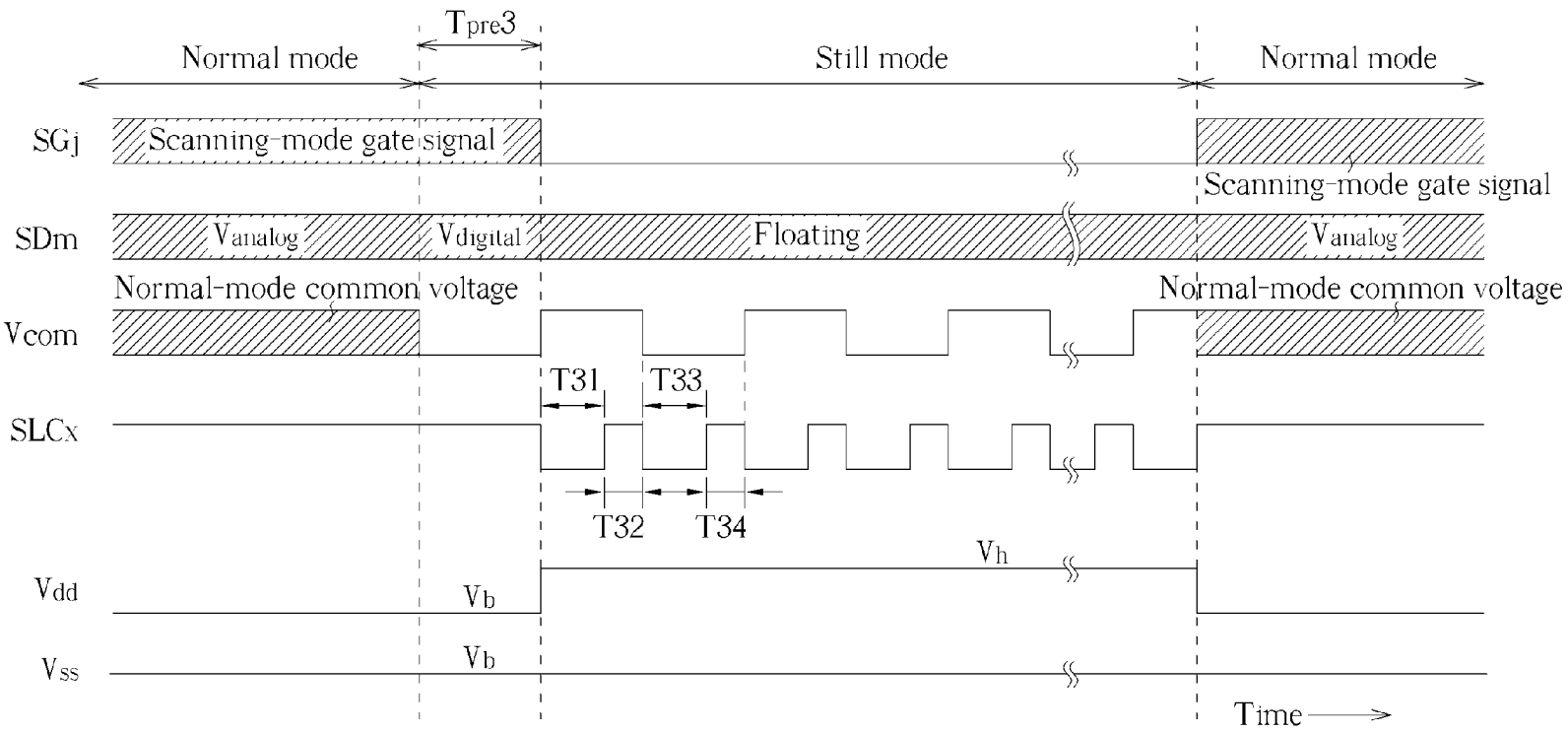
FIG. 11 is a schematic diagram showing related signal waveforms regarding a first circuit operation case of the liquid crystal display shown in FIG. 8, having time along the abscissa.

FIG. 11 is a schematic diagram showing related signal waveforms regarding the first circuit operation case of the liquid crystal display 500 shown in FIG. 8, having time along the abscissa. The signal waveforms in FIG. 11, from top to bottom, are the gate signal SGj, the data signal SDm, the common voltage Vcom, the control signal SLCx, the first power voltage Vdd, and the second power voltage Vss. When the liquid crystal display 500 is working in a normal mode, the data signal SDm provided by the source driver 520 is a multi-level analog voltage Vanalog, the gate driver 510 provides the gate signal SGj based on a normal scanning mode, the data switch 555 inputs the data signal SDm to become the first data signal SDy1 according to the gate signal SGj under the normal scanning mode, the common voltage Vcom provided by the common voltage generation unit 596 is an AC voltage or a DC voltage required for normal-mode operation, the control unit 595 provides the control signal SLCx having high voltage level for disabling the voltage-control inverter 560 and for turning on the pass transistor 590 so as to pass the first data signal SDy1 to become the second data signal SDy2, and both the first power voltage Vdd and the second power voltage Vss generated by the control unit 595 are low voltage Vb.

After the liquid crystal display 500 enters a still mode for displaying a still frame, during a preliminary interval Tpre3, the data signal SDm provided by the source driver 520 is a bi-level digital voltage Vdigital, the data switch 555 inputs the bi-level digital voltage Vdigital to become the first data signal SDy1 according to the gate signal SGj under the normal scanning mode, the common voltage generation unit 596 provides the common voltage Vcom having a first voltage level, the control unit 595 provides the control signal SLCx having high voltage level for continuously disabling the voltage-control inverter 560 and for continuously turning on the pass transistor 590 so as to continue passing the first data signal SDy1 to become the second data signal SDy2, and both the first power voltage Vdd and the second power voltage Vss generated by the control unit 595 hold low voltage Vb. Besides, the gate driver 510 is turned off after the data switch 555 inputs the bi-level digital voltage Vdigital to become the first data signal SDy1. Further, the source driver 520 is turned off after the gate driver 510 is turned off and thus the data signal SDm becomes a floating voltage.

During a first still interval T31, the common voltage generation unit 596 switches the voltage level of the common voltage Vcom from the first voltage level to a second voltage level. The control unit 595 switches the first power voltage Vdd from low voltage Vb to high voltage Vh. The control unit 595 provides the control signal SLCx having low voltage level for turning off the pass transistor 590 and for enabling the voltage-control inverter 560. And the voltage-control inverter 560 enabled then inverts the first data signal SDy1 for generating the second data signal SDy2 furnished to the liquid crystal capacitor 580. During a second still interval T32, the control unit 595 provides the control signal SLCx having high voltage level for disabling the voltage-control inverter 560 and for turning on the pass transistor 590. And the pass transistor 590 turned on is then utilized for passing the second data signal SDy2 to become the first data signal SDy1. It is noted that the falling edge of the control signal SLCx is not required to align the falling/rising edge of the common voltage Vcom.

The circuit operations during a third still interval T33 and a fourth still interval T34 are similar to the aforementioned circuit operations during the first still interval T31 and the second still interval T32 respectively, differing only in that the common voltage generation unit 596 switches the voltage level of the common voltage Vcom from the second voltage level to the first voltage level. In another embodiment, after entering the still mode, the common voltage generation unit 596 may provide the common voltage Vcom having fixed voltage level. After the fourth still interval T34, as long as the operation of the still mode continues, the liquid crystal display 500 performs the aforementioned circuit operations of the first through fourth still intervals T31~T34 periodically and repetitively. When the liquid crystal display 500 ceases the operation of the still mode, the liquid crystal display 500 may return to the normal mode. If the operation of the liquid crystal display 500 changes from the still mode to the normal mode, the control unit 595 switches the first power voltage Vdd from high voltage Vh to low voltage Vb, the source driver 520 is turned on for providing the data signal SDm having the multi-level analog voltage Vanalog, the gate driver 510 is turned on for providing the gate signal SGj based on the normal scanning mode, and the common voltage Vcom provided by the common voltage generation unit 596 returns to the AC or DC voltage required for normal-mode operation. If the common voltage Vcom in FIG. 11 is replaced with the first and second common voltages Vcom1/Vcom2, the signal waveforms illustrated in FIG. 11 can be applied to make clear the operation of the liquid crystal display 600 shown in FIG. 9.

Figure 12:
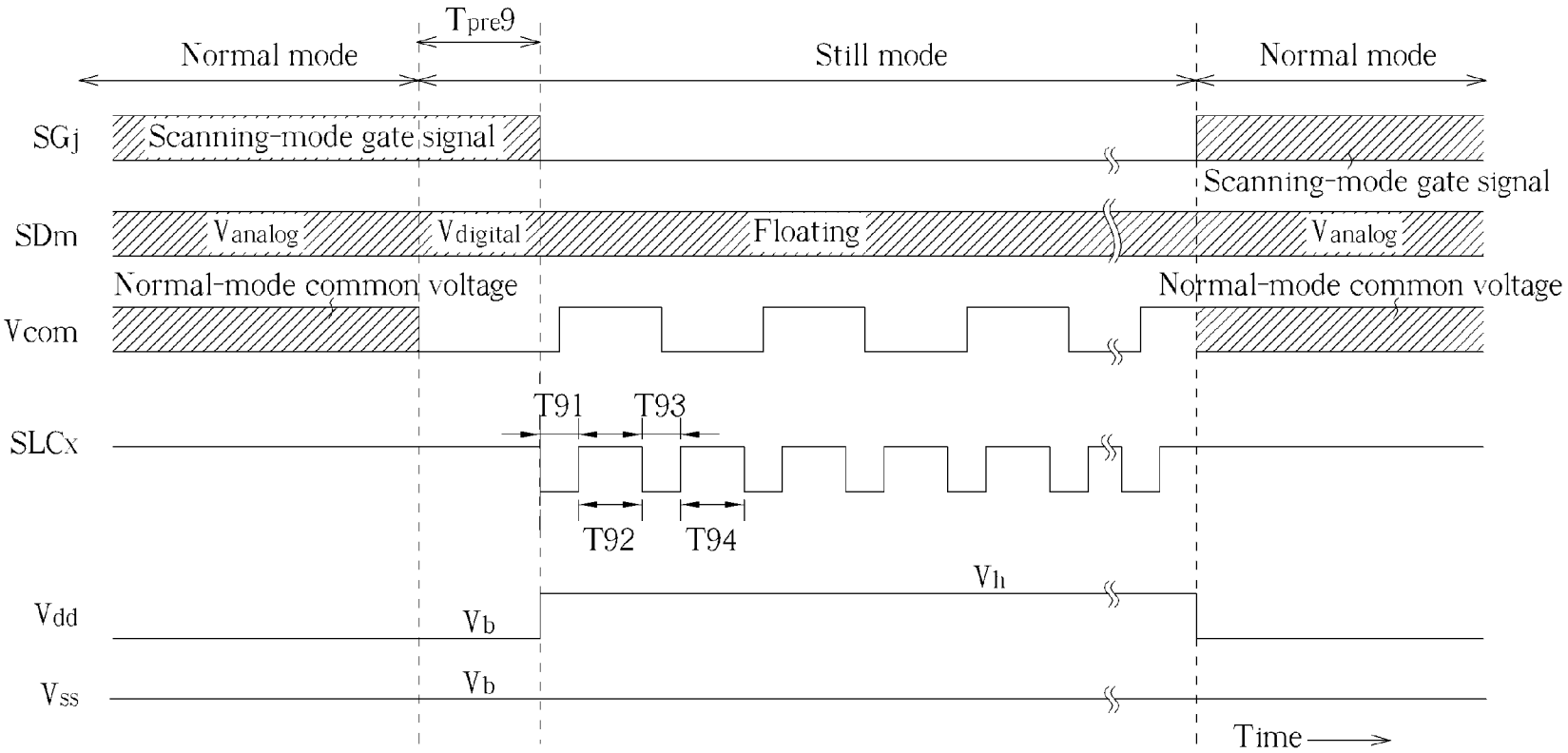
FIG. 12 is a schematic diagram showing related signal waveforms regarding a second circuit operation case of the liquid crystal display shown in FIG. 8, having time along the abscissa.

FIG. 12 is a schematic diagram showing related signal waveforms regarding a second circuit operation case of the liquid crystal display 500 shown in FIG. 8, having time along the abscissa. The signal waveforms in FIG. 12, from top to bottom, are the gate signal SGj, the data signal SDm, the common voltage Vcom, the control signal SLCx, the first power voltage Vdd, and the second power voltage Vss. When the liquid crystal display 500 is working in a normal mode or during a preliminary interval Tpre9 under a still mode, the signal waveforms shown in FIG. 12 are identical to the signal waveforms of the first circuit operation case illustrated in FIG. 11, and for the sake of brevity, further similar discussion thereof is omitted.

During a first still interval T91 under the still mode, the common voltage generation unit 596 switches the voltage level of the common voltage Vcom from the first voltage level to the second voltage level. The control unit 595 switches the first power voltage Vdd from low voltage Vb to high voltage Vh. The control unit 595 provides the control signal SLCx having low voltage level for turning off the pass transistor 590 and for enabling the voltage-control inverter 560. And the voltage-control inverter 560 enabled then inverts the first data signal SDy1 for generating the second data signal SDy2 furnished to the liquid crystal capacitor 580.

During a second still interval T92 under the still mode, the control unit 595 provides the control signal SLCx having high voltage level for disabling the voltage-control inverter 560 and for turning on the pass transistor 590. And the pass transistor 590 turned on is then utilized for passing the second data signal SDy2 to become the first data signal SDy1. It is noted that the falling/rising edge of the control signal SLCx is not required to align the falling/rising edge of the common voltage Vcom. Besides, the rising edge of the first power voltage Vdd is required only to occur before the first falling edge of the control signal SLCx after entering the still mode, i.e. the rising edge of the first power voltage Vdd is not required to align the falling edge of the control signal SLCx.

The circuit operations during a third still interval T93 and a fourth still interval T94 are similar to the aforementioned circuit operations during the first still interval T91 and the second still interval T92 respectively, differing only in that the common voltage generation unit 596 switches the voltage level of the common voltage Vcom from the second voltage level to the first voltage level during the third still interval T93. In another embodiment, after entering the still mode, the common voltage generation unit 596 may provide the common voltage Vcom having fixed voltage level. After the fourth still interval T94, as long as the operation of the still mode continues, the liquid crystal display 500 performs the aforementioned circuit operations of the first through fourth still intervals T91~T94 periodically and repetitively. When the liquid crystal display 500 ceases the operation of the still mode, the operation of the liquid crystal display 500 may change from the still mode to the normal mode, and the corresponding signal waveforms thereof shown in FIG. 12 are identical to those of the first circuit operation case illustrated in FIG. 11. Similarly, if the common voltage Vcom in FIG. 12 is replaced with the first and second common voltages Vcom1/Vcom2, the signal waveforms illustrated in FIG. 12 can be applied to make clear the operation of the liquid crystal display 600 shown in FIG. 9.

Figure 13:
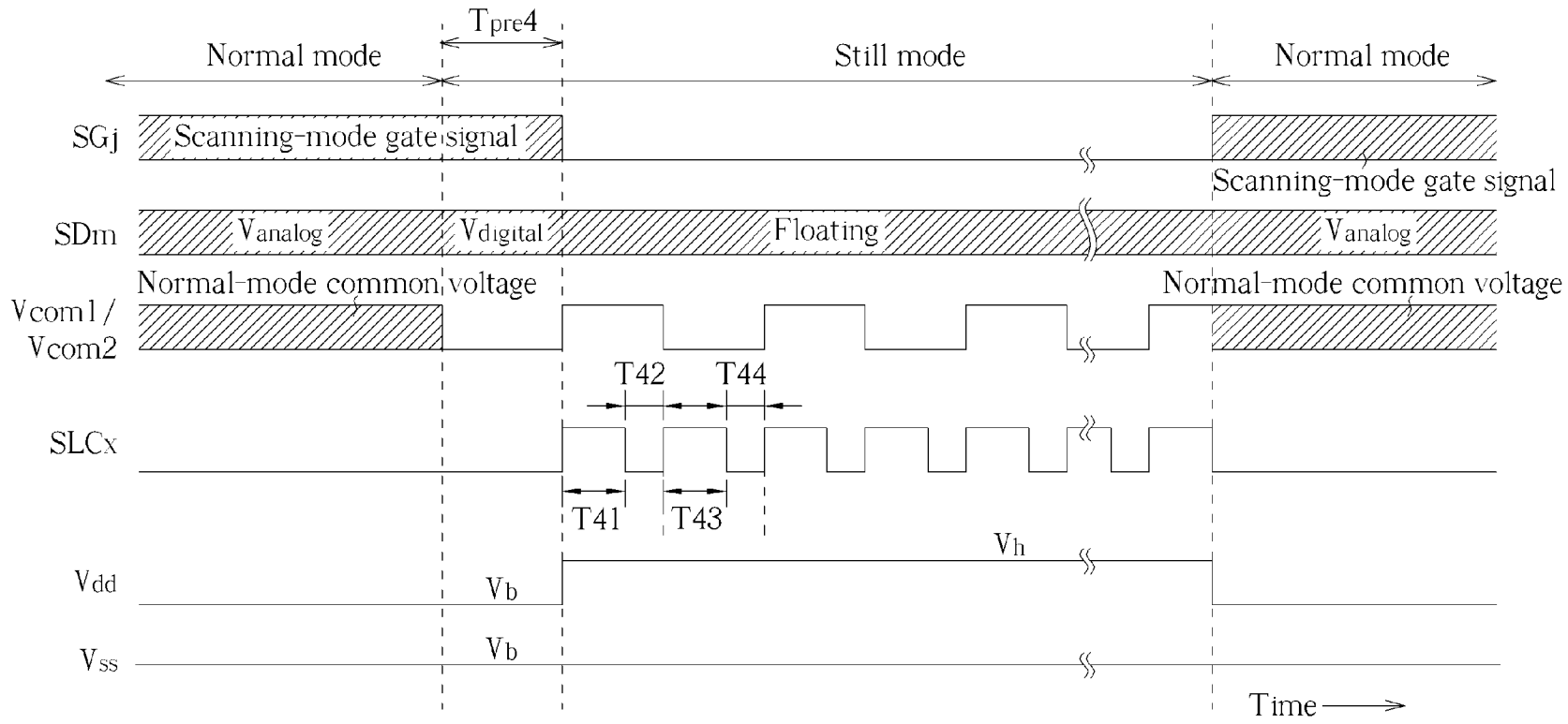
FIG. 13 is a schematic diagram showing related signal waveforms regarding the circuit operation of the liquid crystal display shown in FIG. 10, having time along the abscissa.

FIG. 13 is a schematic diagram showing related signal waveforms regarding the circuit operation of the liquid crystal display 700 shown in FIG. 10, having time along the abscissa. The signal waveforms in FIG. 13, from top to bottom, are the gate signal SGj, the data signal SDm, the first and second common voltages Vcom1/Vcom2, the control signal SLCx, the first power voltage Vdd, and the second power voltage Vss. When the liquid crystal display 700 is working in a normal mode, the data signal SDm provided by the source driver 520 is a multi-level analog voltage Vanalog, the gate driver 510 provides the gate signal SGj based on a normal scanning mode, the data switch 555 inputs the data signal SDm to become the first data signal SDy1 according to the gate signal SGj under the normal scanning mode, the first and second common voltages Vcom1/Vcom2 provided by the common voltage generation unit 696 are AC or DC voltages required for normal-mode operation, the control unit 595 provides the control signal SLCx having low voltage level for disabling the voltage-control inverter 760 and for turning on the pass transistor 790 so as to pass the first data signal SDy1 to become the second data signal SDy2, and both the first power voltage Vdd and the second power voltage Vss generated by the control unit 595 are low voltage Vb.

After the liquid crystal display 700 enters a still mode for displaying a still frame, during a preliminary interval Tpre4, the data signal SDm provided by the source driver 520 is a bi-level digital voltage Vdigital, the data switch 555 inputs the bi-level digital voltage Vdigital to become the first data signal SDy1 according to the gate signal SGj under the normal scanning mode, the common voltage generation unit 696 provides the first and second common voltages Vcom1/Vcom2 having a first voltage level, the control unit 595 provides the control signal SLCx having low voltage level for continuously disabling the voltage-control inverter 760 and for continuously turning on the pass transistor 790 so as to continue passing the first data signal SDy1 to become the second data signal SDy2, and both the first power voltage Vdd and the second power voltage Vss generated by the control unit 595 hold low voltage Vb. Besides, the gate driver 510 is turned off after the data switch 555 inputs the bi-level digital voltage Vdigital to become the first data signal SDy1. Further, the source driver 520 is turned off after the gate driver 510 is turned off and thus the data signal SDm becomes a floating voltage.

During a first still interval T41, the common voltage generation unit 696 switches the voltage level of the first and second common voltages Vcom1/Vcom2 from the first voltage level to a second voltage level. The control unit 595 switches the first power voltage Vdd from low voltage Vb to high voltage Vh. The control unit 595 provides the control signal SLCx having high voltage level for turning off the pass transistor 790 and for enabling the voltage-control inverter 760. And the voltage-control inverter 760 enabled then inverts the first data signal SDy1 for generating the second data signal SDy2 furnished to the liquid crystal capacitor 680. During a second still interval T42, the control unit 595 provides the control signal SLCx having low voltage level for disabling the voltage-control inverter 760 and for turning on the pass transistor 790. And the pass transistor 790 turned on is then utilized for passing the second data signal SDy2 to become the first data signal SDy1. It is noted that the rising edge of the control signal SLCx is not required to align the falling/rising edge of the first and second common voltages Vcom1/Vcom2.

The circuit operations during a third still interval T43 and a fourth still interval T44 are similar to the aforementioned circuit operations during the first still interval T41 and the second still interval T42 respectively, differing only in that the common voltage generation unit 696 switches the voltage level of the first and second common voltages Vcom1/Vcom2 from the second voltage level to the first voltage level. In another embodiment, after entering the still mode, the common voltage generation unit 696 may provide the first and second common voltages Vcom1/Vcom2 having fixed voltage level. After the fourth still interval T44, as long as the operation of the still mode continues, the liquid crystal display 700 performs the aforementioned circuit operations of the first through fourth still intervals T41~T44 periodically and repetitively. When the liquid crystal display 700 ceases the operation of the still mode, the liquid crystal display 700 may return to the normal mode. If the operation of the liquid crystal display 700 changes from the still mode to the normal mode, the control unit 595 switches the first power voltage Vdd from high voltage Vh to low voltage Vb, the source driver 520 is turned on for providing the data signal SDm having the multi-level analog voltage Vanalog, the gate driver 510 is turned on for providing the gate signal SGj based on the normal scanning mode, and the first and second common voltages Vcom1/Vcom2 provided by the common voltage generation unit 696 return to the AC or DC voltages required for normal-mode operation.

Figure 14:
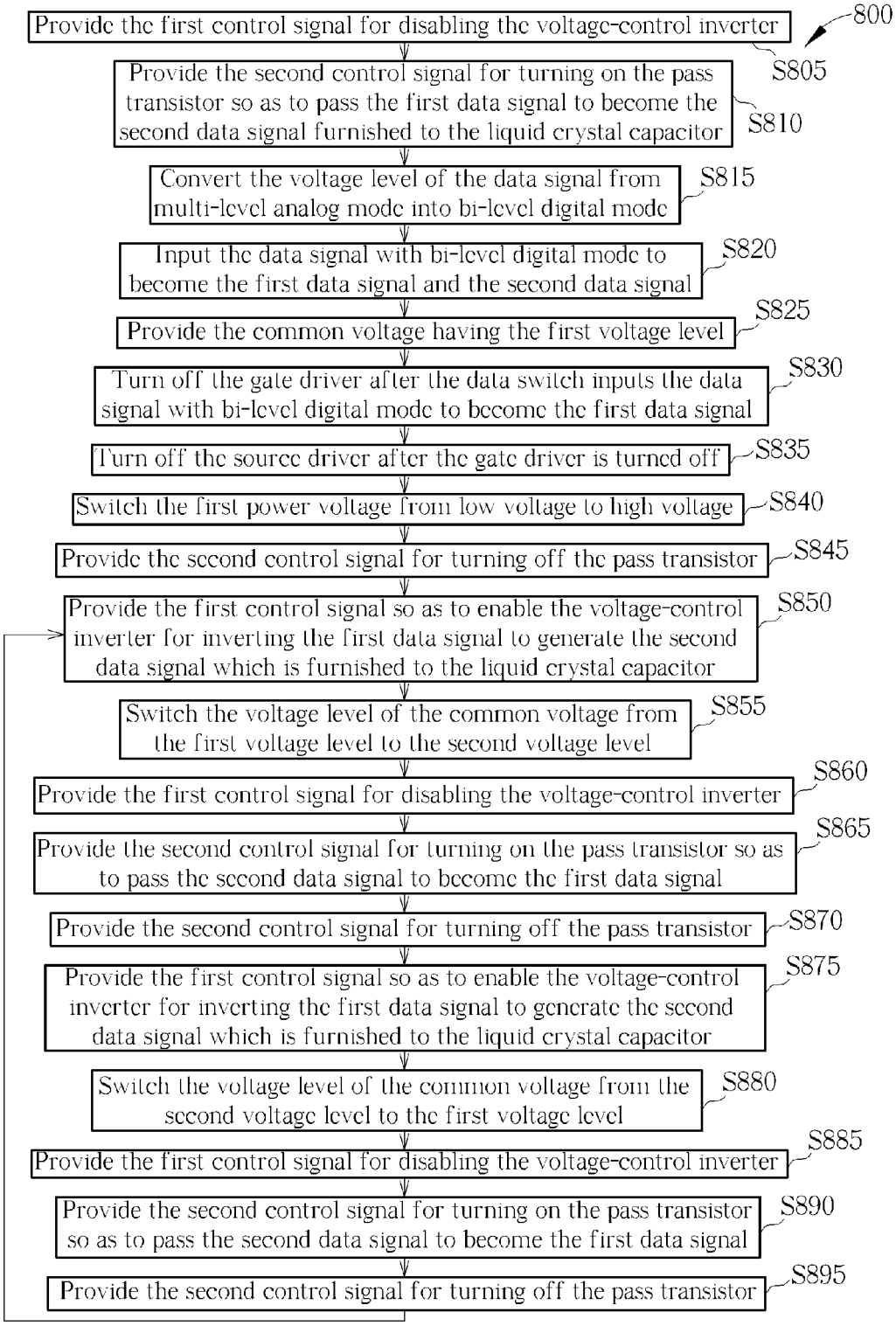
FIG. 14 is a flowchart depicting an operation method according to the present invention.

FIG. 14 is a flowchart depicting an operation method according to the present invention. The operation method regarding the flow 800 shown in FIG. 14 is implemented based on the liquid crystal display 200 shown in FIG. 2. The operation method illustrated in the flow 800 comprises the following steps:

Step S805: The control unit provides the first control signal for disabling the voltage-control inverter.

Step S810: The control unit provides the second control signal for turning on the pass transistor so as to pass the first data signal to become the second data signal furnished to the liquid crystal capacitor.

Step S815: The source driver converts the voltage level of the data signal from multi-level analog mode into bi-level digital mode.

Step S820: The data switch inputs the data signal with bi-level digital mode to become the first data signal and the second data signal according to the gate signal under scanning mode.

Step S825: The common voltage generation unit provides the common voltage having the first voltage level.

Step S830: Turn off the gate driver after the data switch inputs the data signal with bi-level digital mode to become the first data signal.

Step S835: Turn off the source driver after the gate driver is turned off.

Step S840: The control unit switches the first power voltage from low voltage to high voltage.

Step S845: The control unit provides the second control signal for turning off the pass transistor.

Step S850: The control unit provides the first control signal so as to enable the voltage-control inverter for inverting the first data signal to generate the second data signal which is furnished to the liquid crystal capacitor.

Step S855: The common voltage generation unit switches the voltage level of the common voltage from the first voltage level to the second voltage level.

Step S860: The control unit provides the first control signal for disabling the voltage-control inverter.

Step S865: The control unit provides the second control signal for turning on the pass transistor so as to pass the second data signal to become the first data signal.

Step S870: The control unit provides the second control signal for turning off the pass transistor.

Step S875: The control unit provides the first control signal so as to enable the voltage-control inverter for inverting the first data signal to generate the second data signal which is furnished to the liquid crystal capacitor.

Step S880: The common voltage generation unit switches the voltage level of the common voltage from the second voltage level to the first voltage level.

Step S885: The control unit provides the first control signal for disabling the voltage-control inverter.

Step S890: The control unit provides the second control signal for turning on the pass transistor so as to pass the second data signal to become the first data signal.

Step S895: The control unit provides the second control signal for turning off the pass transistor. Go to step S850.

In another embodiment, the aforementioned voltage level of the common voltage in the flow 800 is a fixed voltage level, i.e. the second voltage level equals the first voltage level. Besides, if the common voltage is replaced with the first and second common voltages in the flow 800, the operation method disclosed in the flow 800 can be applied to both the liquid crystal display 300 in FIG. 3 and the liquid crystal display 400 in FIG. 4. It is noted that if the control unit provides the first control signal having high voltage level for disabling the voltage-control inverter, the control unit provides the first control signal having low voltage level for enabling the voltage-control inverter, and vice versa. Similarly, if the control unit provides the second control signal having high voltage level for turning on the pass transistor, the control unit provides the second control signal having low voltage level for turning off the pass transistor, and vice versa.

Figure 15:
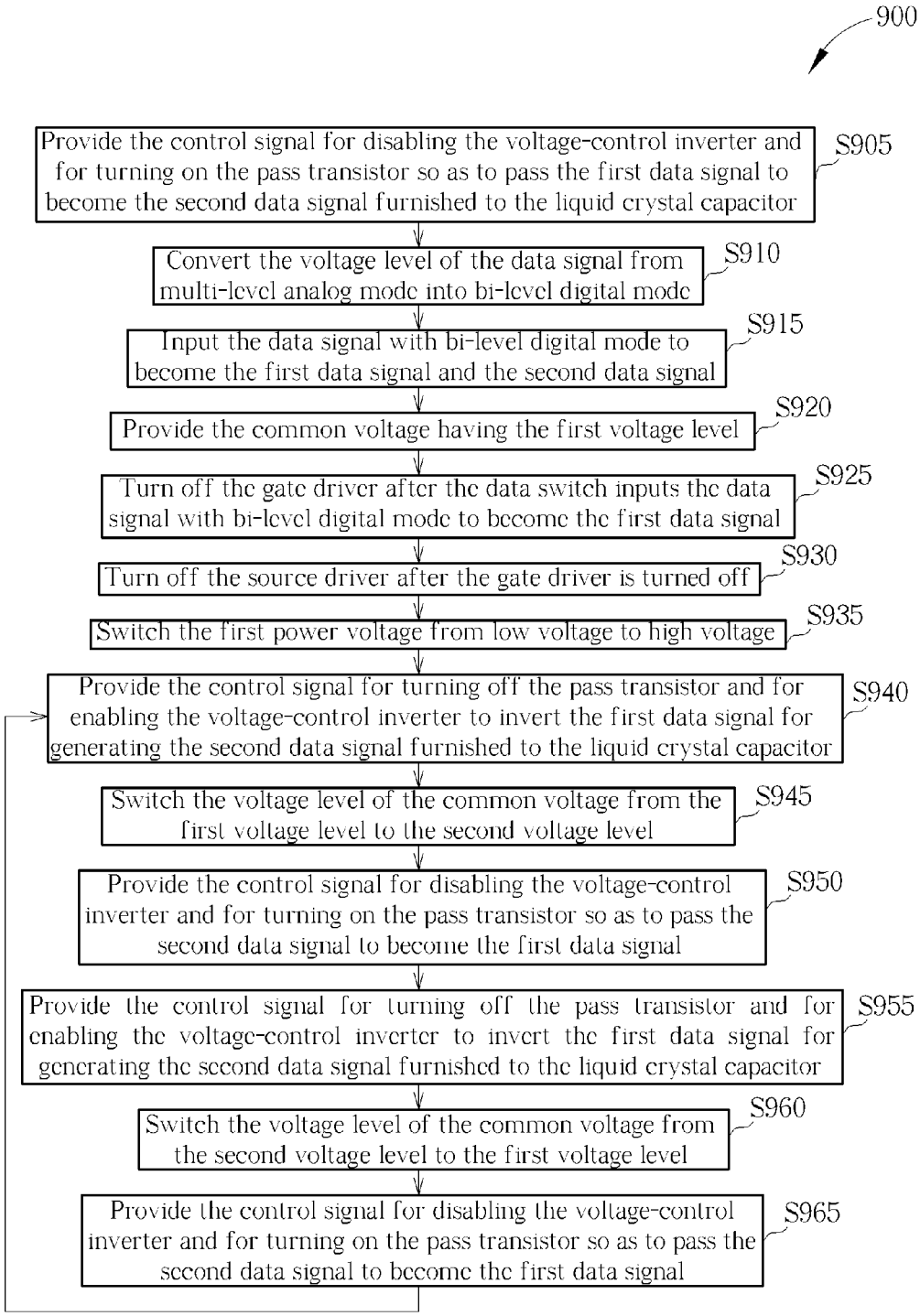
FIG. 15 is a flowchart depicting another operation method according to the present invention.

FIG. 15 is a flowchart depicting another operation method according to the present invention. The operation method regarding the flow 900 shown in FIG. 15 is implemented based on the liquid crystal display 500 shown in FIG. 8. The operation method illustrated in the flow 900 comprises the following steps:

Step S905: The control unit provides the control signal for disabling the voltage-control inverter and for turning on the pass transistor so as to pass the first data signal to become the second data signal furnished to the liquid crystal capacitor.

Step S910: The source driver converts the voltage level of the data signal from multi-level analog mode into bi-level digital mode.

Step S915: The data switch inputs the data signal with bi-level digital mode to become the first data signal and the second data signal according to the gate signal under scanning mode.

Step S920: The common voltage generation unit provides the common voltage having the first voltage level.

Step S925: Turn off the gate driver after the data switch inputs the data signal with bi-level digital mode to become the first data signal.

Step S930: Turn off the source driver after the gate driver is turned off.

Step S935: The control unit switches the first power voltage from low voltage to high voltage.

Step S940: The control unit provides the control signal for turning off the pass transistor and for enabling the voltage-control inverter to invert the first data signal for generating the second data signal furnished to the liquid crystal capacitor.

Step S945: The common voltage generation unit switches the voltage level of the common voltage from the first voltage level to the second voltage level.

Step S950: The control unit provides the control signal for disabling the voltage-control inverter and for turning on the pass transistor so as to pass the second data signal to become the first data signal.

Step S955: The control unit provides the control signal for turning off the pass transistor and for enabling the voltage-control inverter to invert the first data signal for generating the second data signal furnished to the liquid crystal capacitor.

Step S960: The common voltage generation unit switches the voltage level of the common voltage from the second voltage level to the first voltage level.

Step S965: The control unit provides the control signal for disabling the voltage-control inverter and for turning on the pass transistor so as to pass the second data signal to become the first data signal. Go to step S940.

In another embodiment, the aforementioned voltage level of the common voltage in the flow 900 is a fixed voltage level, i.e. the second voltage level equals the first voltage level. Besides, if the common voltage is replaced with the first and second common voltages in the flow 900, the operation method disclosed in the flow 900 can be applied to both the liquid crystal display 600 in FIG. 9 and the liquid crystal display 700 in FIG. 10. It is noted that if the control unit provides the control signal having high voltage level for disabling the voltage-control inverter and for turning on the pass transistor, the control unit provides the control signal having low voltage level for enabling the voltage-control inverter and for turning off the pass transistor, and vice versa.

In conclusion, the liquid crystal display of the present invention provides the pixel data self-retaining functionality based on simplified pixel circuit structure for reducing the power consumption of displaying a still frame and also for performing a data self-refreshing operation. Accordingly, compared with the prior-art liquid crystal display having pixel units based on SRAM architecture, the circuit structure of the pixel units in the liquid crystal display of the present invention is significantly simplified to increase the aperture ratio of each pixel unit and also to bring the cost down.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A liquid crystal display, comprising:

a gate line for delivering a gate signal;

a data line for delivering a data signal;

a data switch comprising a first end directly connected to the data line for receiving the data signal, a gate end directly connected to the gate line for receiving the gate signal, and a second end;

a voltage-control inverter comprising an input end directly connected to the second end of the data switch, an output end, and an enable end;

a liquid crystal capacitor directly connected to the output end of the voltage-control inverter;

a pass transistor comprising a first end directly connected to the output end of the voltage-control inverter, a second end directly connected to the input end of the voltage-control inverter, and a gate end;

a control unit, electrically connected to the enable end of the voltage-control inverter and the gate end of the pass transistor, for enabling or disabling the voltage-control inverter;

a common voltage generation unit electrically connected to the liquid crystal capacitor; and a power source, electrically connected to the control unit and the common voltage generation unit, for powering the control unit and the common voltage generation unit.

2. The liquid crystal display of claim 1, wherein the common voltage generation unit comprises an output end for outputting a common voltage furnished to the liquid crystal capacitor, and wherein the liquid crystal display further comprises:

a storage capacitor electrically connected between the output end of the voltage-control inverter and the output end of the common voltage generation unit;

wherein the common voltage is a DC voltage or an AC voltage.

3. An operation method, comprising:

providing the liquid crystal display as claimed in claim 2;

the control unit providing a second control signal for turning off the pass transistor during a first still interval after the liquid crystal display enters a still mode;

the control unit providing a first control signal so as to enable the voltage-control inverter for inverting a first data signal to generate a second data signal which is furnished to the liquid crystal capacitor during the first still interval;

the control unit providing the first control signal for disabling the voltage-control inverter during a second still interval;

the control unit providing the second control signal for turning off the pass transistor during the second still interval;

the control unit providing the first control signal for disabling the voltage-control inverter during a third still interval;

the control unit providing the second control signal for turning on the pass transistor so as to pass the second data signal to become the first data signal during the third still interval;

the control unit providing the first control signal for disabling the voltage-control inverter during a fourth still interval; and the control unit providing the second control signal for turning off the pass transistor during the fourth still interval.

4. The operation method of claim 3, wherein the first still interval is followed by the second, third and fourth still intervals sequentially.

5. The operation method of claim 4, further comprising:

a source driver for converting a voltage level of the data signal from multi-level analog mode into bi-level digital mode during a preliminary interval prior to the first still interval;

the data switch inputting the data signal with bi-level digital mode to become the first data signal according to the gate signal during the preliminary interval;

the common voltage generation unit providing the common voltage having a first voltage level during the preliminary interval;

the common voltage generation unit switching the common voltage from the first voltage level to a second voltage level during the first still interval; and the common voltage generation unit switching the common voltage from the second voltage level to the first voltage level during a fifth still interval following the fourth still interval.

6. The operation method of claim 5, further comprising:

turning off a gate driver after the data switch inputs the data signal with bi-level digital mode to become the first data signal according to the gate signal; and turning off the source driver after turning off the gate driver.

7. The operation method of claim 5, further comprising:

the control unit providing the first control signal for disabling the voltage-control inverter during the preliminary interval; and the control unit providing the second control signal for turning on the pass transistor so as to pass the first data signal to become the second data signal furnished to the liquid crystal capacitor during the preliminary interval.

8. The operation method of claim 4, further comprising:

turning on a source driver for providing the data signal with multi-level analog mode required for normal-mode operation after the third still interval;

turning on a gate driver for providing the gate signal so as to input the data signal with multi-level analog mode to become the first data signal after the third still interval;

the common voltage generation unit providing the common voltage required for normal-mode operation after the third still interval;

the control unit providing the first control signal for disabling the voltage-control inverter after the third still interval; and the control unit providing the second control signal for turning on the pass transistor so as to pass the first data signal to become the second data signal after the third still interval.

9. The operation method of claim 3, wherein the fourth still interval is followed by the first, second and third still intervals sequentially.

10. The operation method of claim 9, further comprising:

a source driver for converting a voltage level of the data signal from multi-level analog mode into bi-level digital mode during a preliminary interval prior to the fourth still interval;

the data switch inputting the data signal with bi-level digital mode to become the first data signal according to the gate signal during the preliminary interval;

the common voltage generation unit providing the common voltage having a first voltage level during the preliminary interval and the fourth still interval;

the common voltage generation unit switching the common voltage from the first voltage level to a second voltage level during the first still interval; and the common voltage generation unit switching the common voltage from the second voltage level to the first voltage level during a fifth still interval after the third still interval.

11. The operation method of claim 10, further comprising:

turning off a gate driver after the data switch inputs the data signal with bi-level digital mode to become the first data signal according to the gate signal; and turning off the source driver after turning off the gate driver.

12. The operation method of claim 10, further comprising:

the control unit providing the first control signal for disabling the voltage-control inverter during the preliminary interval; and the control unit providing the second control signal for turning on the pass transistor so as to pass the first data signal to become the second data signal furnished to the liquid crystal capacitor during the preliminary interval.

13. The operation method of claim 10, further comprising:

the control unit providing the second control signal for turning off the pass transistor during the preliminary interval; and the control unit providing the first control signal so as to enable the voltage-control inverter for inverting the first data signal to generate the second data signal which is furnished to the liquid crystal capacitor during the preliminary interval.

14. The operation method of claim 9, further comprising:

turning on a source driver for providing the data signal with multi-level analog mode required for normal-mode operation after the third still interval;

turning on a gate driver for providing the gate signal so as to input the data signal with multi-level analog mode to become the first data signal after the third still interval;

the common voltage generation unit providing the common voltage required for normal-mode operation after the fourth still interval;

the control unit providing the first control signal for disabling the voltage-control inverter after the third still interval; and the control unit providing the second control signal for turning on the pass transistor so as to pass the first data signal to become the second data signal after the third still interval.

15. The liquid crystal display of claim 1, wherein:

the voltage-control inverter further comprises a first power input end and a second power input end; and the control unit comprises a first signal output end electrically connected to the enable end of the voltage-control inverter, a second signal output end electrically connected to the gate end of the pass transistor, a first voltage output end electrically connected to the first power input end of the voltage-control inverter, and a second voltage output end electrically connected to the second power input end of the voltage-control inverter.

16. The liquid crystal display of claim 1, wherein the common voltage generation unit comprises a first output end for outputting a first common voltage furnished to the liquid crystal capacitor and a second output end for outputting a second common voltage, and wherein the liquid crystal display further comprises: a storage capacitor electrically connected between the output end of the voltage-control inverter and the second output end of the common voltage generation unit;

wherein the first and second common voltages are DC voltages or AC voltages.

17. The liquid crystal display of claim 1, wherein:

the voltage-control inverter further comprises a first power input end and a second power input end; and the control unit comprises a signal output end electrically connected to the enable end of the voltage-control inverter and the gate end of the pass transistor, a first voltage output end electrically connected to the first power input end of the voltage-control inverter, and a second voltage output end electrically connected to the second power input end of the voltage-control inverter.

18. The liquid crystal display of claim 1, wherein the control unit comprises a signal output end, a first voltage output end and a second voltage output end, and wherein the voltage-control inverter comprises:

a first transistor comprising a first end electrically connected to the first voltage output end of the control unit, a gate end directly electrically connected to the second end of the data switch, and a second end;

a second transistor comprising a first end electrically connected to the second end of the first transistor, a gate end electrically connected to the signal output end of the control unit, and a second end directly electrically connected to the liquid crystal capacitor and the first end of the pass transistor;

a third transistor comprising a first end electrically connected to the second end of the second transistor, a gate end electrically connected to the gate end of the second transistor, and a second end; and a fourth transistor comprising a first end electrically connected to the second end of the third transistor, a gate end electrically connected to the gate end of the first transistor, and a second end electrically connected to the second voltage output end of the control unit.

19. The liquid crystal display of claim 18, wherein the first transistor and the pass transistor are P-type thin film transistors or P-type field effect transistors, and the second transistor, the third transistor and the fourth transistor are N-type thin film transistors or N-type field effect transistors.

20. The liquid crystal display of claim 1, wherein the control unit comprises a signal output end, a first voltage output end and a second voltage output end, and wherein the voltage-control inverter comprises:

a first transistor comprising a first end electrically connected to the first voltage output end of the control unit, a gate end is configured to controlled by the second end of the data switch, and a second end;

a second transistor comprising a first end electrically connected to the second end of the first transistor, a gate end is configured to controlled by the signal output end of the control unit, and a second end electrically connected to the liquid crystal capacitor and the first end of the pass transistor;

a third transistor comprising a first end electrically connected to the second end of the second transistor, a gate end is configured to controlled by the signal output end of the control unit, and a second end; and a fourth transistor comprising a first end electrically connected to the second end of the third transistor, a gate end is configured to controlled by the second end of the data switch, and a second end electrically connected to the second voltage output end of the control unit.

21. The liquid crystal display of claim 1, further comprising:

a gate driver, electrically connected to the gate line, for providing the gate signal; and a source driver, electrically connected to the data line, for providing the data signal.

22. An operation method, comprising:

providing a liquid crystal display, the liquid crystal display comprising:

a gate driver for providing a gate signal;

a source driver for providing a data signal;

a control unit for providing a control signal;

a data switch for providing a control of inputting the data signal to become a first data signal according to the gate signal, the data switch comprising a first end directly connected to a data line for receiving the data signal, a gate end directly connected to a gate line for receiving the gate signal, and a second end;

a voltage-control inverter for inverting the first data signal to generate a second data signal according to an enable operation of the control signal, the voltage-control inverter comprising an input end directly connected to the second end of the data switch, and an output end;

a liquid crystal capacitor directly connected to the output end of the voltage-control inverter for controlling liquid-crystal transmittance according to the second data signal and a common voltage;

a pass transistor comprising a first end directly connected to the output end of the voltage-control inverter, and a second end directly connected to the input end of the voltage-control inverter, for providing a control of passing the second data signal to become the first data signal according to the control signal, or for providing a control of passing the first data signal to become the second data signal according to the control signal; and a common voltage generation unit for providing the common voltage;

the control unit providing the control signal having a first voltage level for turning off the pass transistor and for enabling the voltage-control inverter during a first still interval after the liquid crystal display enters a still mode so as to invert the first data signal for generating the second data signal;

furnishing the second data signal to the liquid crystal capacitor when the first data signal is inverted during the first still interval; and the control unit providing the control signal having a second voltage level for disabling the voltage-control inverter and for turning on the pass transistor so as to pass the second data signal to become the first data signal during a second still interval.

23. The operation method of claim 22, further comprising: the source driver converting a voltage level of the data signal from multi-level analog mode into bi-level digital mode during a preliminary interval prior to the first still interval;

the data switch inputting the data signal with bi-level digital mode to become the first data signal according to the gate signal during the preliminary interval;

the common voltage generation unit providing the common voltage having a third voltage level during the preliminary interval;

the common voltage generation unit switching the common voltage from the third 10 voltage level to a fourth voltage level during the first still interval; and the common voltage generation unit switching the common voltage from the fourth voltage level to the third voltage level during a third still interval.

24. The operation method of claim 23, further comprising: turning off the gate driver after the data switch inputs the data signal with bi-level digital mode to become the first data signal according to the gate signal; and turning off the source driver after turning off the gate driver.

25. The operation method of claim 23, further comprising: the control unit providing the control signal having the second voltage level for disabling the voltage-control inverter and for turning on the pass transistor so as to pass the first data signal to become the second data signal furnished to the liquid crystal capacitor during the preliminary interval.

26. The operation method of claim 22, further comprising: turning on the source driver for providing the data signal with multi-level analog mode required for normal-mode operation after the second still interval;

turning on the gate driver for providing the gate signal so as to input the data signal with multi-level analog mode to become the first data signal after the 30 second still interval; second still interval;

the common voltage generation unit providing the common voltage required for normal-mode operation after the second still interval; and the control unit providing the control signal having the second voltage level for 5 disabling the voltage-control inverter and for turning on the pass transistor so as to pass the first data signal to become the second data signal after the second still interval.

* * * * *